US009777956B2

(12) United States Patent
Lee et al.

(10) Patent No.: US 9,777,956 B2
(45) Date of Patent: Oct. 3, 2017

(54) REFRIGERATOR

(71) Applicant: LG Electronics Inc., Seoul (KR)

(72) Inventors: Sangbong Lee, Seoul (KR); Jangseok Lee, Seoul (KR); Hyoungkeun Lim, Seoul (KR); Myungjin Chung, Seoul (KR); Minkyu Oh, Seoul (KR); Namsoo Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 373 days.

(21) Appl. No.: 14/532,191

(22) Filed: Nov. 4, 2014

(65) Prior Publication Data

US 2015/0121927 A1 May 7, 2015

(30) Foreign Application Priority Data

Nov. 4, 2013 (KR) ..... 10-2013-0133028
Nov. 7, 2013 (KR) ..... 10-2013-0134918

(51) Int. Cl.
*F25D 11/02* (2006.01)
*F25B 49/02* (2006.01)
(Continued)

(52) U.S. Cl.
CPC ..... *F25D 11/022* (2013.01); *F25B 5/02* (2013.01); *F25B 49/02* (2013.01); *F25B 6/04* (2013.01);
(Continued)

(58) Field of Classification Search
CPC .... F25B 5/02; F25B 2400/16; F25B 2400/23; F25B 49/02; F25D 11/022
(Continued)

(56) References Cited

U.S. PATENT DOCUMENTS 4,856,288 A * 8/1989 Weber ..... B60H 1/00585 137/412
7,293,428 B2 * 11/2007 Itsuki ..... F25B 1/10 62/222
(Continued)

FOREIGN PATENT DOCUMENTS

CN 1375673 10/2002
CN 2650035 10/2004
(Continued)

OTHER PUBLICATIONS

Chinese Office Action and Search Report dated Jun. 27, 2016 issued in Application No. 201410612967.5.

*Primary Examiner* — Marc Norman
(74) *Attorney, Agent, or Firm* — Ked & Associates, LLP

(57) ABSTRACT

A refrigerator is provided that may include at least one compressor that compresses a refrigerant, a condenser that condenses the refrigerant compressed in the at least one compressor, a refrigerant tube that guides the refrigerant condensed in the condenser, a plurality of evaporation passages, in which expansion devices may be respectively disposed, the plurality of evaporation passages branching from the refrigerant tube, a flow adjuster disposed in the refrigerant tube to supply the refrigerant into at least one evaporation passage of the plurality of evaporation passages, a plurality of evaporators, respectively, connected to the plurality of evaporation passages to evaporate the refrigerant decompressed in the plurality of expansion devices, and a liquid refrigerant supply device disposed at an outlet-side of the condenser to separate a liquid refrigerant of the refrigerant heat-exchanged in the condenser, thereby supplying the liquid refrigerant into the flow adjuster.

26 Claims, 13 Drawing Sheets

(51) Int. Cl.
*F25B 5/02* (2006.01)
*F25B 6/04* (2006.01)

(52) U.S. Cl.
CPC ..... *F25B 2400/16* (2013.01); *F25B 2400/23* (2013.01); *F25B 2600/01* (2013.01); *F25B 2600/2511* (2013.01); *F25B 2700/21174* (2013.01); *F25B 2700/21175* (2013.01)

(58) Field of Classification Search
USPC ..... 62/199, 200, 509
See application file for complete search history.

(56) References Cited

U.S. PATENT DOCUMENTS

| | | | | |
|---|---|---|---|---|
| 2006/0218952 | A1* | 10/2006 | Nagae | F25B 1/10 62/216 |
| 2012/0235551 | A1* | 9/2012 | Park | F25D 23/028 312/404 |
| 2013/0213065 | A1* | 8/2013 | Gomes | F25B 5/02 62/117 |

FOREIGN PATENT DOCUMENTS

| | | |
|---|---|---|
| CN | 1746595 | 3/2006 |
| CN | 1873354 | 12/2006 |
| CN | 1886626 | 12/2006 |
| EP | 2530394 | 12/2012 |
| JP | 2002-031422 | 1/2002 |

* cited by examiner

REFRIGERATOR

CROSS-REFERENCE TO RELATED APPLICATION(S)

The present application claims priority under 35 U.S.C. 119 and 35 U.S.C. 365 to Korean Patent Application No. 10-2013-0133028, filed in Korea on Nov. 4, 2013, and No. 10-2013-0134918, filed in Korea on Nov. 7, 2013, which are hereby incorporated by reference in their entirety.

BACKGROUND

1. Field

A refrigerator is disclosed herein.

2. Background

In general, a refrigerator has a plurality of storage compartments to accommodate food to be stored so as to store the food in a frozen or refrigerated state. The storage compartment may have one surface that is open to receive or dispense the food. The plurality of storage compartments may include a freezer compartment to store food in the frozen state, and a refrigerator compartment to store food in the refrigerated state.

A refrigeration system, in which a refrigerant is circulated, is driven in the refrigerator. The refrigeration system may include a compressor, a condenser, an expansion device, and an evaporator. The evaporator may include a first evaporator disposed at a side of the refrigerator compartment and a second evaporator disposed at a side of the freezer compartment.

Cool air stored in the refrigerator compartment may be cooled while passing through the first evaporator, and the cooled cool air may be supplied again into the refrigerator compartment. Also, the cool air stored in the freezer compartment may be cooled while passing through the second evaporator, and the cooled cool air may be supplied again into the freezer compartment.

As described above, in the refrigerator according to the related art, independent cooling may be performed in the plurality of storage compartments through separate evaporators. Also, the plurality of storage compartments are not simultaneously cooled, but rather, one storage compartment or the other storage compartment is selectively or alternately cooled.

In this case, although the storage compartment in which the cooling is performed is maintained to or at an adequate temperature, the storage compartment in which the cooling is not performed may increase in temperature, and thus, extend out of a normal temperature range. Also, in a state in which the cooling of one storage compartment is required, if it is determined that the other storage compartment extends out of the normal temperature range, the other storage compartment may be not immediately cooled. As a result, in the structure in which the storage compartments are independently cooled, the cool air is not supplied at a suitable time and place causing a lack in refrigerant during the operation, thereby deteriorating operation efficiency of the refrigerator.

A flow adjustment part or flow adjuster disposed at an inlet-side of the plurality of evaporators to introduce the refrigerant into at least one evaporator of the plurality of evaporators may be provided. In the case of the refrigerator according to the related art, the flow adjustment part may not be maintained in physical balance, and thus, a relatively large amount of refrigerant may be introduced into one evaporator, and a relatively small amount of refrigerant may be introduced into the other evaporator.

In detail, the refrigerant heat-exchanged in the condenser may contain a gaseous refrigerant which is not completely condensed. That is, the refrigerant passing through the condenser may be a two-phase refrigerant containing liquid refrigerant and gaseous refrigerant. When the two-phase refrigerant is supplied into the flow adjustment part, and the flow adjustment part is not maintained in physical balance, the liquid refrigerant may be introduced into the evaporator connected to an inclined portion of the flow adjustment part, and the gaseous refrigerant may be introduced into the evaporator connected to a portion opposite to the inclined portion of the flow adjustment part. In this case, the evaporator in which the gaseous refrigerant is introduced may be deteriorated in heat-exchange efficiency.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. The embodiments may, however, be embodied in many different forms and should not be construed as being limited to the embodiments set forth herein; rather, alternate embodiments included in other retrogressive embodiments or falling within the spirit and scope will fully convey the concept to those skilled in the art.

Figure 1:
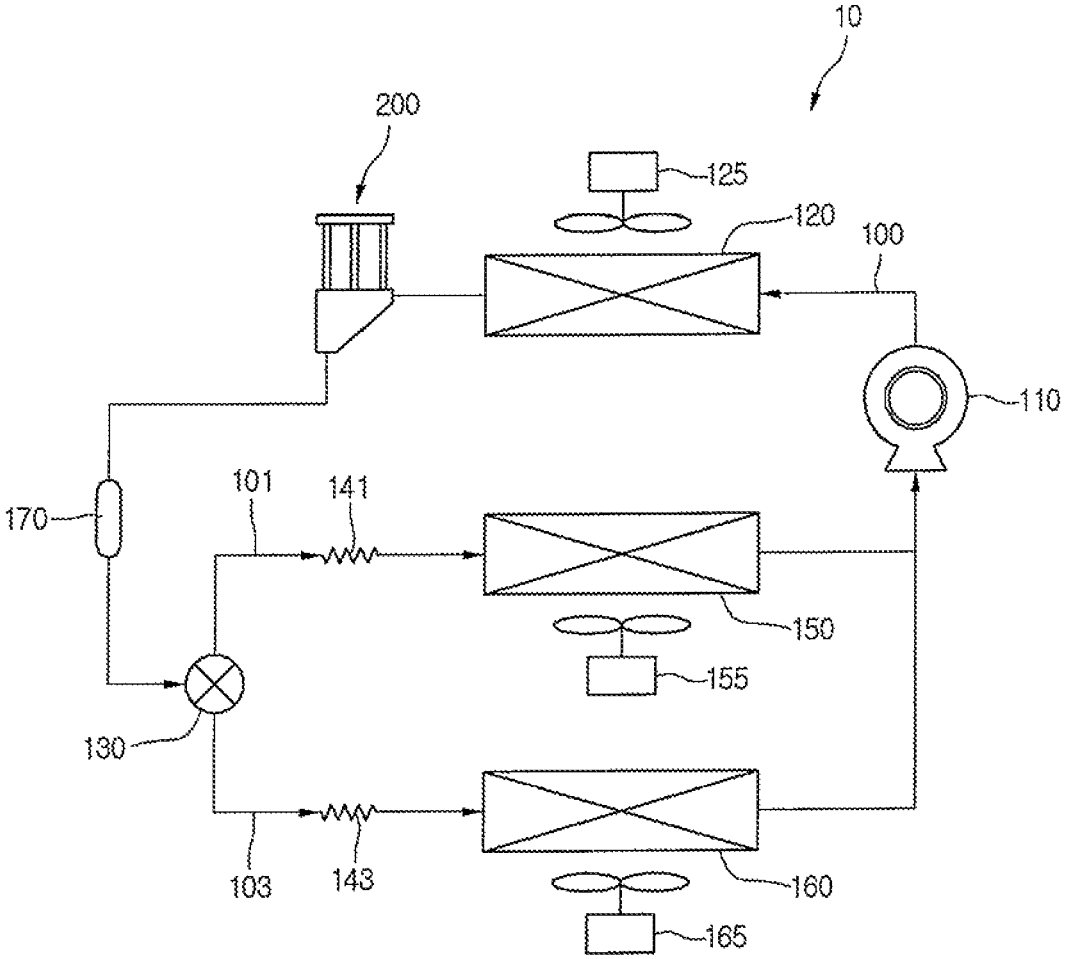
FIG. 1 is a schematic diagram of a refrigeration cycle in a refrigerator according to an embodiment.

FIG. 1 is a schematic diagram of a refrigeration cycle in a refrigerator according to an embodiment. Referring to FIG. 1, a refrigerator 10 according to this embodiment may include a plurality of devices to drive a refrigeration cycle.

In detail, the refrigerator 10 may include a compressor 110 that compresses a refrigerant, a condenser 120 that condenses the refrigerant compressed in the compressor 110, a plurality of expansion devices 141 and 143 that decompress the refrigerant condensed in the condenser 120, and a plurality of evaporators 150 and 160 that evaporate the refrigerant decompressed in the plurality of expansion devices 141 and 143. The refrigerator 10 may further include a refrigerant tube 100 that connects the compressor 110, the condenser 120, the plurality of expansion devices 141 and 143, and the plurality of evaporators 150 and 160 to each other to guide a flow of the refrigerant.

The plurality of evaporators 150 and 160 may include a first evaporator 150 to generate cool air to be supplied into one storage compartment of a refrigerator compartment and a freezer compartment, and a second evaporator 160 to generate cool air to be supplied into the other storage compartment. For example, the first evaporator 150 may function as a refrigerator compartment-side evaporator to supply cool air into the refrigerator compartment, and the second evaporator 160 may function as a freezer compartment-side evaporator to supply cool air into the freezer compartment.

The plurality of expansion devices 141 and 143 may include a first expansion device 141 that expands the refrigerant to be introduced into the first evaporator 150, and a second expansion device 143 that expands the refrigerant to be introduced into the second evaporator 160. Each of the first and second expansion devices 141 and 143 may include a capillary tube.

A first refrigerant passage 101 that guides introduction of the refrigerant into the first evaporator 150, and in which the first expansion device 141 may be disposed, may be defined or provided at an inlet-side of the first evaporator 150. The first refrigerant passage 101 may be referred to as a "first evaporation passage" in that the first refrigerant passage 102 guides the introduction of the refrigerant into the first evaporator 150.

A second refrigerant passage 103 that guides introduction of the refrigerant into the second evaporator 160, and in which the second expansion device 143 may be disposed, may be defined or provided at an inlet-side of the second evaporator 160. The second refrigerant passage 103 may be referred to as a "second evaporation passage" in that the second refrigerant passage 103 guides the introduction of the refrigerant into the second evaporator 160. The first and second refrigerant passages 101 and 103 may be referred to as "branch passages" that branch from the refrigerant tube 100.

The refrigerator 10 may further include a flow adjuster 130 that divides and introduces the refrigerant into the first and second refrigerant passages 101 and 103. For example, the flow adjuster 130 may be a device that operates the first and second evaporators 150 and 160 at the same time, that is, adjusts a flow of the refrigerant so that the refrigerant is introduced into the first and second evaporators 150 and 160. The flow adjuster 130 may operate to allow the refrigerant to be introduced into only one of the first and second evaporators 150 and 160. The flow adjuster 130 may include a three-way valve having one inflow, through which the refrigerant may be introduced, and two discharges, through which the refrigerant may be discharged. The first and second refrigerant passages 101 and 103 may be connected to the two discharges of the flow adjuster 130, respectively. Thus, the refrigerant passing through the flow adjuster 130 may be divided and discharged into the first and second refrigerant passages 101 and 103. The discharges connected to the first and second refrigerant passages 101 and 103 may be referred to as a "first discharge" and a "second discharge", respectively.

At least one of the first and second discharges may be open. When both of the first and second discharges are open, the refrigerant may flow through the first and second refrigerant passages 101 and 103. On the other hand, when the first discharge is open, and the second discharge is closed, the refrigerant may flow through the first refrigerant passage 101. Also, when the second discharge is open, and the first discharge is closed, the refrigerant may flow through the second refrigerant passage 103.

The refrigerator 10 may include blower fans 125, 155, and 165 disposed on or at one side each of the heat exchangers to blow air. The blower fans 125, 155, and 165 may include a condensation fan 125 provided on or at one side of the condenser 120, a first evaporation fan 155 provided on or at one side of the first evaporator 150, and a second evaporation fan 165 provided on or at one side of the second evaporator 160.

Each of the first and second evaporators 150 and 160 may vary in heat-exchange performance according to a rotation rate of each of the first evaporation fans 155 and 165. For example, if a large amount of refrigerant is required according to the operation of the evaporator 150, the first evaporation fan 155 may increase in rotation rate. Also, if cool air is sufficient, the first evaporation fan 155 may be reduced in rotation rate.

The refrigerator 10 may further include a liquid refrigerant supply device 200 disposed on or at an outlet-side of the condenser 120 to introduce a liquid refrigerant of the two-phase refrigerant passing through the condenser 120 into the flow adjuster 130. The liquid refrigerant supply device 200 may be a device that separates the liquid refrigerant of the two-phase refrigerant to supply the separated liquid refrigerant into the flow adjuster 130 and that additionally condenses a gaseous refrigerant to change in phase the gaseous refrigerant into liquid refrigerant and then to supply the liquid refrigerant into flow adjuster 130. The liquid refrigerant supply device 200 may be referred to as an "auxiliary condensation device".

The refrigerator 10 may further include a dryer 170 disposed between the liquid refrigerant supply device 200 and the flow adjuster 130 to remove moisture or impurities of the liquid refrigerant discharged from the liquid refrigerant supply device 200. The liquid refrigerant, from which the moisture and impurities may be removed by the dryer 170, may be introduced into the flow adjuster 130.

Figure 2:
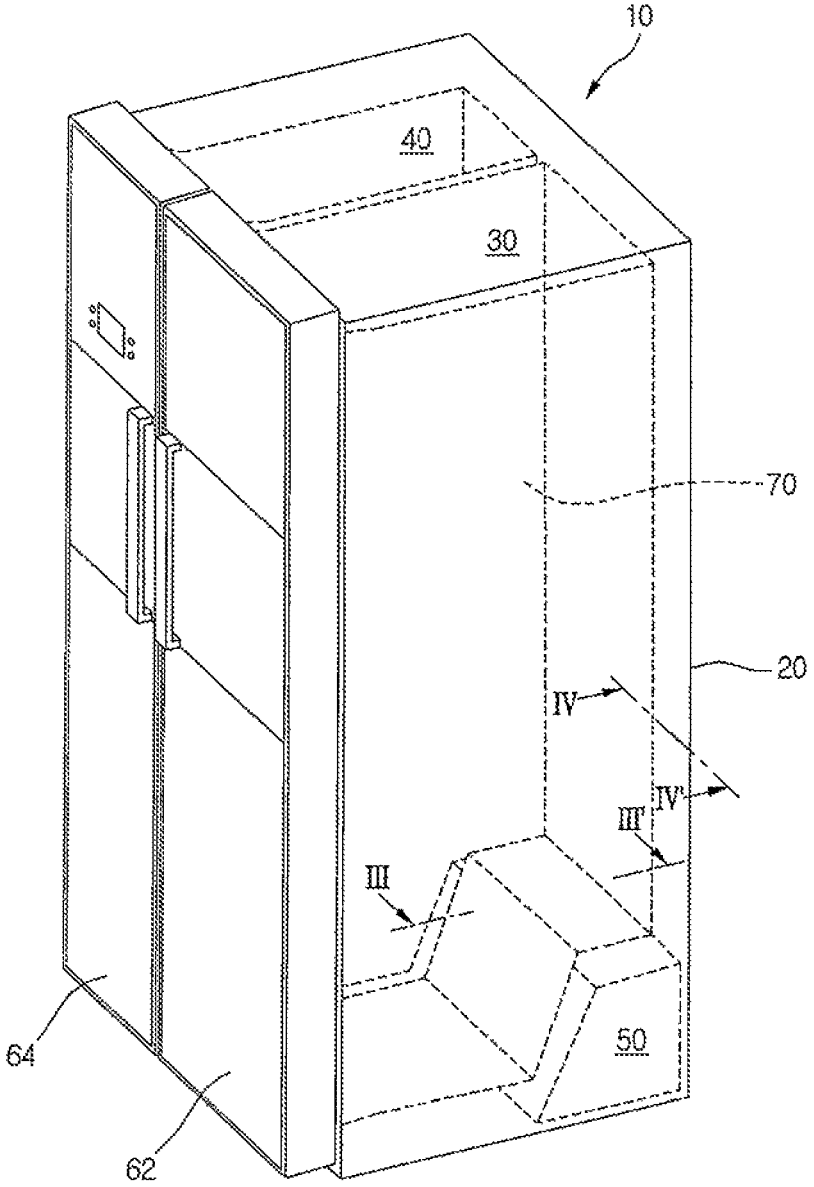
FIG. 2 is a perspective view of a refrigerator according to an embodiments.
Figure 3:
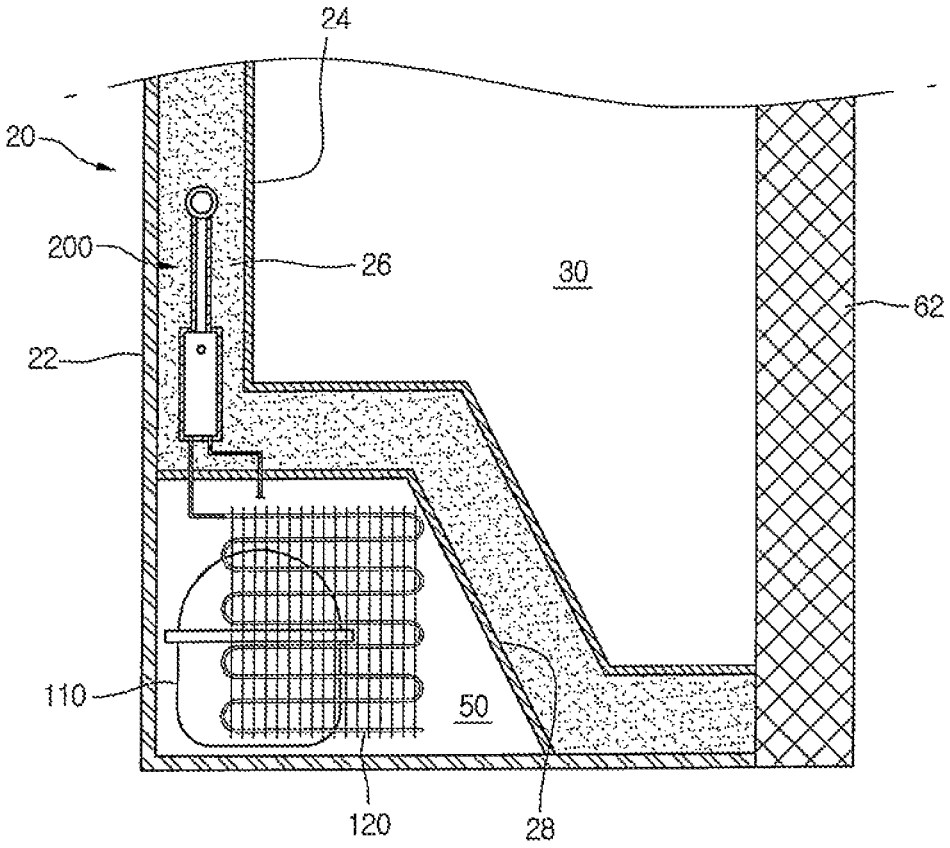
FIG. 3 is a cross-sectional view taken along line III-III' of FIG. 2.
Figure 4:
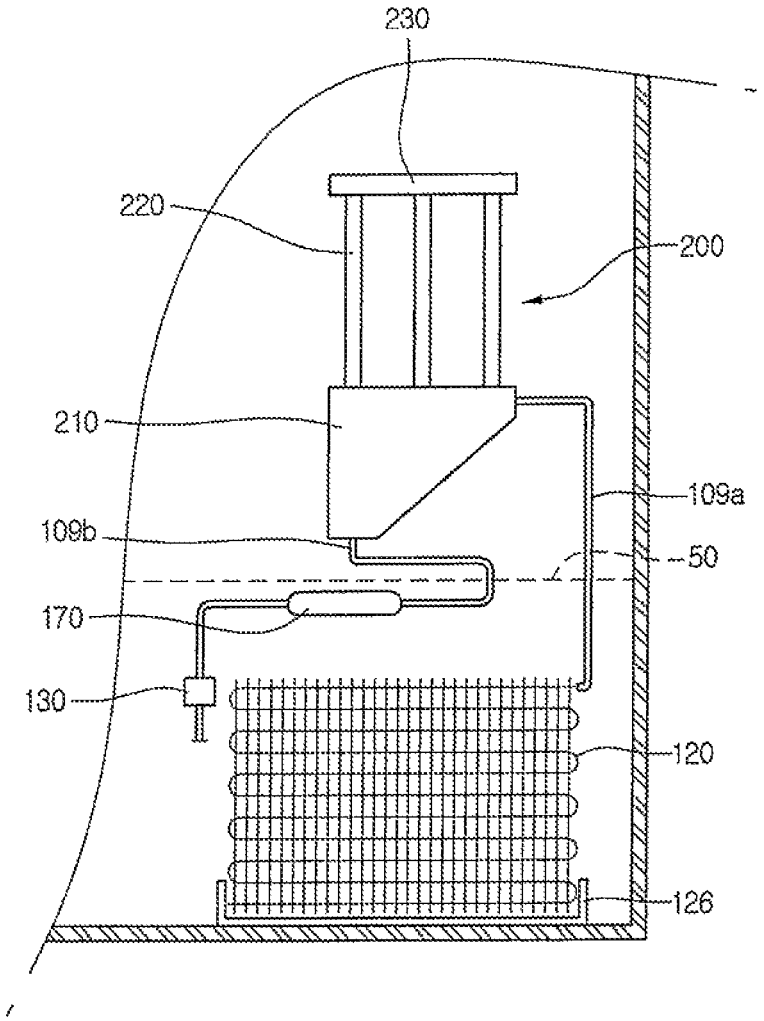
FIG. 4 is a cross-sectional view taken along line IV-IV' of FIG. 2.

FIG. 2 is a perspective view of a refrigerator according to an embodiment, FIG. 3 is a cross-sectional view taken along line III-III' of FIG. 2. FIG. 4 is a cross-sectional view taken along line IV-IV' of FIG. 2.

Referring to FIGS. 2 to 4, the refrigerator 10 according to this embodiment may include a main body 20 that defines the storage compartments, that is, the refrigerator compartment 30 and the freezer compartment 40, and a plurality of doors 62 and 64 rotatably coupled to front portions of the main body 20. The main body 20 may further include a barrier 70 to partition the refrigerator compartment 30 and the freezer compartment 40 from each other.

The plurality of doors 62 may include a refrigerator compartment door 62 to selectively open and close the refrigerator compartment 30, and a freezer compartment door 64 to selectively open and close the freezer compartment 40.

The machine room 50 may be defined in a lower portion of the main body 20. The compressor 110, the condenser 120, the dryer 170, and a drain pan 126 may be disposed in the machine room 50. The drain pan 126 may be disposed under the condenser 120 to store condensate water condensed in the condenser 120.

The main body 20 may further include an outer case 22 that defines an exterior of the refrigerator 10, and an inner case 24 assembled with the outer case 22, in a state in which the inner case 24 is spaced apart from the outer case 24 to define internal exteriors of the refrigerator compartment 30 and the freezer compartment 40.

The first or second evaporator 150 or 160 may be disposed adjacent to the refrigerator compartment 30 or the freezer compartment 40. In detail, when the first evaporator serves as the refrigerator compartment-side evaporator, and the second evaporator serves as the freezer compartment-side evaporator, the freezer compartment-side evaporator may be, for example, disposed at a rear side of the freezer compartment 40, that is, at a rear side of the inner case of the freezer compartment 40. Also, the refrigerator compartment-side evaporator may be disposed on the barrier 70.

A machine room cover 28 that covers an upper side of the machine room 50 may be disposed inside the main body 20. The machine room cover 28 may be assembled with an inside of a lower portion of the outer case 22.

An insulation material 26 to insulate insides of the storage compartments 30 and 40 against the outside may be disposed in each of a space between the outer case 22 and the inner case 24, and a space between the machine room cover 28 and the inner case 24. In addition, the insulation material 26 may be disposed inside the barrier 70.

A liquid refrigerant supply device 200 may be disposed inside the insulation material 26 disposed at a rear side of the storage compartments 30 and 40. For example, the liquid refrigerant supply device 200 may be disposed inside the insulation material 26 between the outer case 22 and the inner case 24, which may be disposed at a rear side of the refrigerator compartment 30.

The liquid refrigerant supply device 200 may receive the refrigerant heat-exchanged in the condenser 120 to supply the liquid refrigerant, which is separated from the refrigerant or changes in phase, into the dryer 170. In detail, the refrigerator 10 may further include an inlet passage 109*a* that extends from an outlet-side of the condenser 120 to the liquid refrigerant supply device 200, and an outlet passage 109*b* that extends from the liquid refrigerant supply device 200 to the dryer 170 or the flow adjuster 130. The inlet passage 109*a* and the outlet passage 109*b* may form portions of the refrigerant tube 100.

The inlet passage 109*a* may be connected to an upper portion of a liquid refrigerant storage 210 of the liquid refrigerant supply device 200. The outlet passage 109*b* may be connected to a lower portion of the liquid refrigerant storage 210. Thus, at least a portion of the refrigerant introduced through the inlet passage 109*a* may flow into the lower portion of the liquid refrigerant storage 210, and then, may be discharged.

Hereinafter, a liquid refrigerant supply device according to an embodiment will be described in detail with reference to the accompanying drawings.

Figure 5:
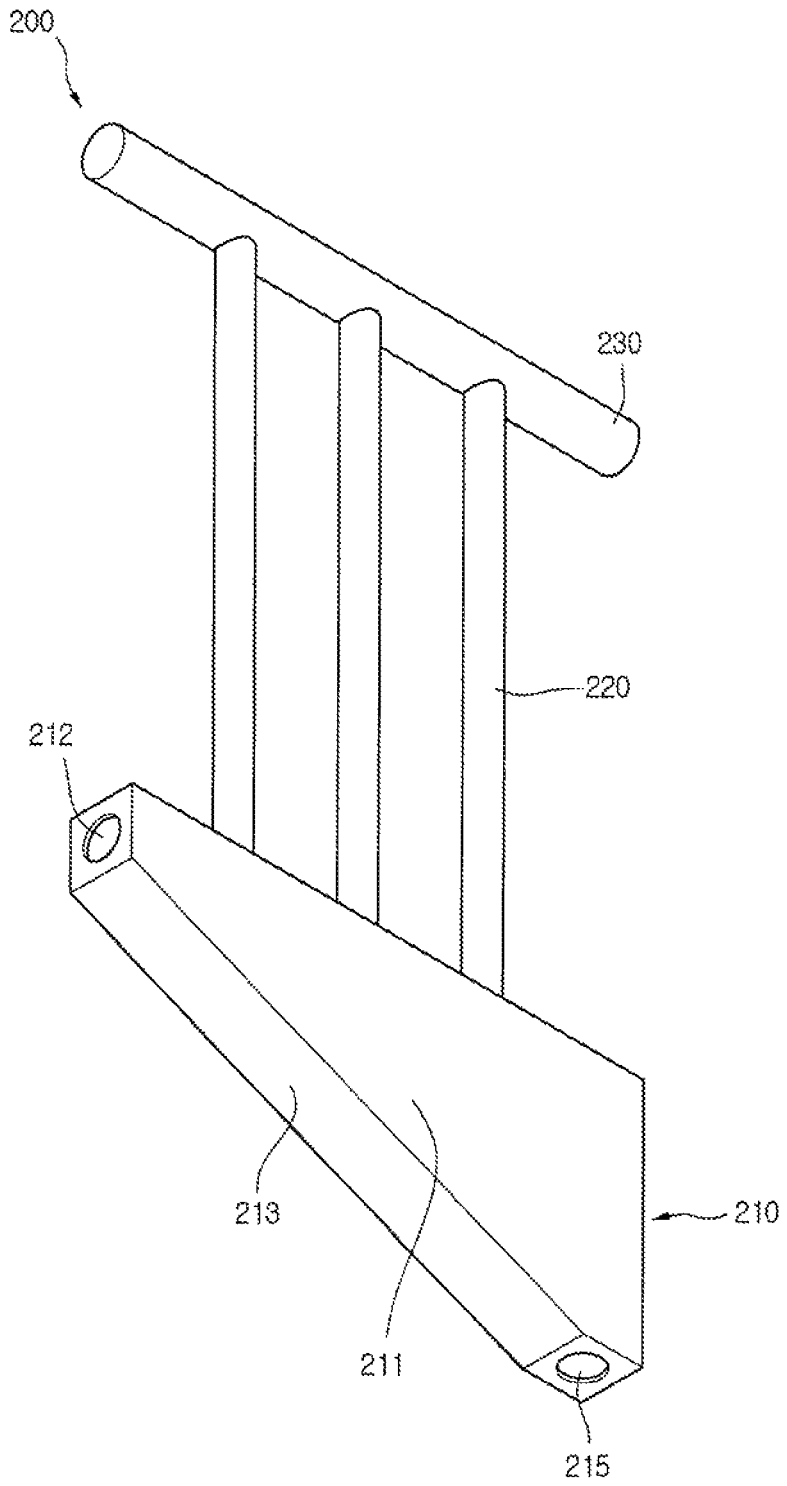
FIG. 5 is a perspective view of a liquid refrigerant supply device according to an embodiment.
Figure 6:
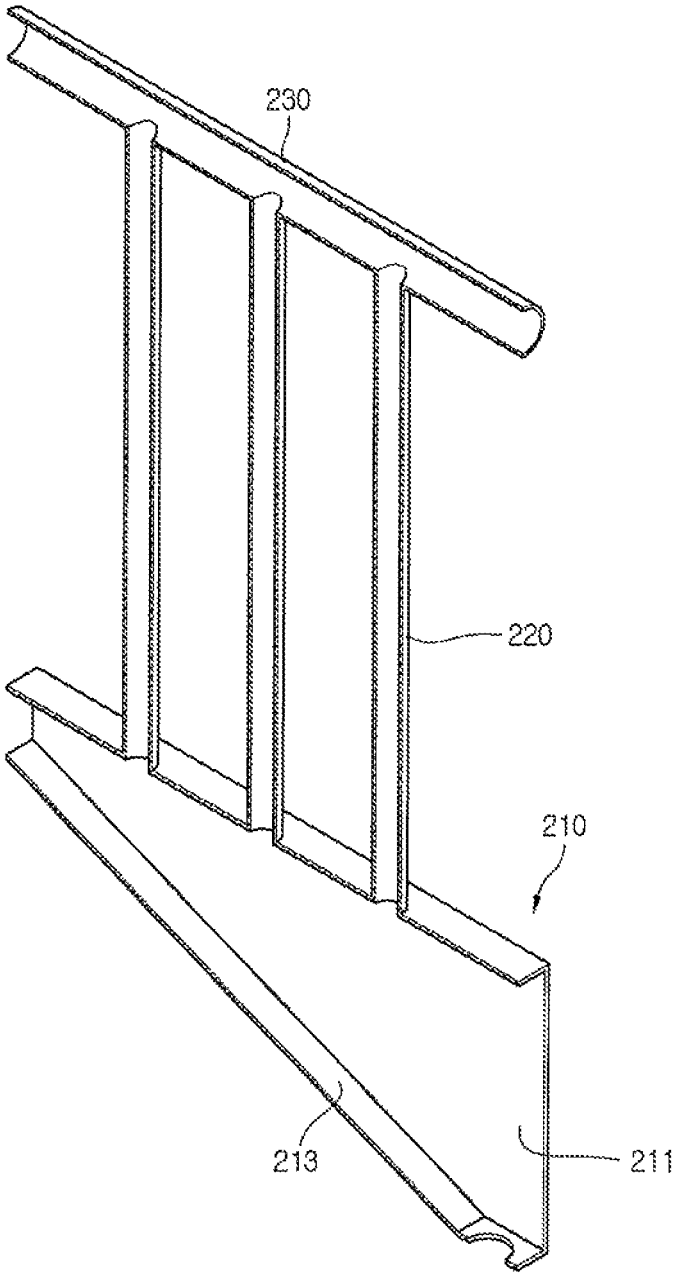
FIG. 6 is a cross-sectional view of the liquid refrigerant supply device of FIG. 5.

FIG. 5 is a perspective view of a liquid refrigerant supply device according to an embodiment. FIG. 6 is a cross-sectional view of the liquid refrigerant supply device of FIG. 5.

Referring to FIGS. 5 to 6, the liquid refrigerant supply device according to an embodiment may include the liquid refrigerant storage 210 that defines a flow space of the refrigerant, at least one extension tube 220 that extends upward from the liquid refrigerant storage 210, and a gaseous refrigerant collection device 230 coupled to the at least one extension tube 200 to collect the gaseous refrigerant. In detail, the liquid refrigerant storage 210 may include a main body 211 having a storage space in which the liquid refrigerant may be stored. The main body 211 may be referred to as a "case" having a predetermined volume.

The main body 211 may include an inlet 212 coupled to the inlet passage 109*a*, and an outlet 215 coupled to the outlet passage 109*b*. The inlet 212 may be disposed on a first side of the main body 211, and the outlet 215 may be disposed on a second side of the main body 211. The inlet 212 and the outlet 215 may be spaced apart from each other.

Also, the inlet 212 may be disposed at a position which is higher than a position of the outlet 215. The two-phase refrigerant after being heat-exchanged in the condenser 120 may be introduced into the inlet 212. Also, the outlet 215 may be disposed at a position which is lower than a position of the inlet 212 so that the liquid refrigerant having a relatively large density of the two-phase refrigerant may flow downward, and then, be discharged.

The main body 211 may further include a guide surface 213 that guides the refrigerant introduced through the inlet 212 to the outlet 215. The guide surface 213 may define one surface of the main body 211 and extend from the inlet 212 to the outlet 215.

As the inlet 212 is disposed above the outlet 215, the guide surface 213 may be inclined to extend downward from the inlet 212 toward the outlet 215. In detail, the guide surface 213 may inclined to extend downward with respect to a horizontal surface. As the guide surface 213 extends at an incline downward, the liquid refrigerant of the two-phase refrigerant introduced through the inlet 212 may flow into the outlet 215 along the guide surface 213 by gravity.

The at least one extension tube 220 may extend upward or vertically from a top surface of the main body 211. The at least one extension tube 220 may provide a passage through which the gaseous refrigerant of the two-phase refrigerant introduced through the inlet 212 may flow or be diffused upward. As the gaseous refrigerant has a density less than a density of the liquid refrigerant, a flow of the gaseous refrigerant along the guide surface 213 may be restricted, and thus, the gaseous refrigerant may flow upward through the at least one extension tube 220. Also, the gaseous refrigerant may be heat-exchanged with the outside of the liquid refrigerant supply device 200, and then, may be condensed while flowing into the at least one extension tube 220.

The at least one extension tube 220 may include a plurality of extension tubes 220. The plurality of extension tubes 220 may be spaced apart from each other and extend substantially in parallel to each other.

The gaseous refrigerant collection device 230 may be coupled to the plurality of extension tubes 220 to cross each other. For example, the gaseous refrigerant collection device 230 may extend in a transverse direction. The gaseous refrigerant flowing through the plurality of extension tubes 220 may be spread into the gaseous refrigerant collection device 230 and be heat-exchanged with the outside of the liquid refrigerant supply device 200, and thus, may be condensed.

Figure 7:
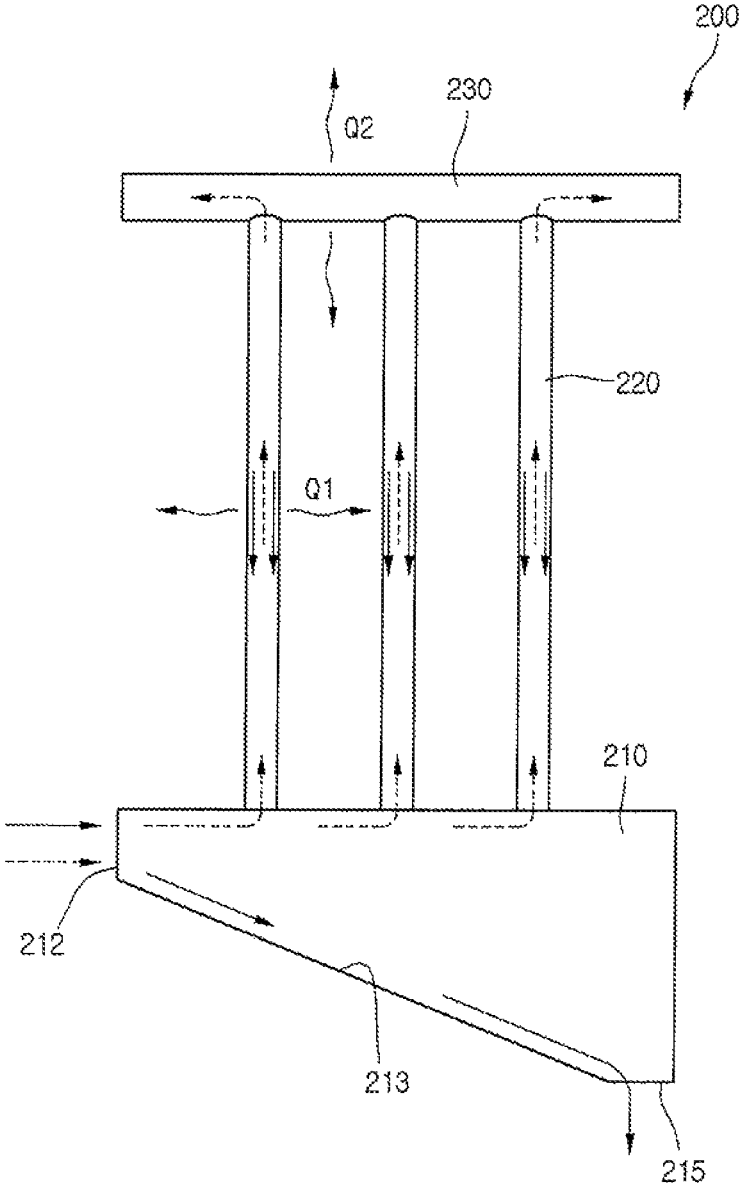
FIG. 7 is a schematic view illustrating refrigerant flow in the liquid refrigerant supply device of FIG. 5.

FIG. 7 is a schematic view illustrating refrigerant flow in the liquid refrigerant supply device of FIG. 5. The refrigerant condensed in the condenser 120 may be introduced into the main body 211 through the inlet 212. The condensed refrigerant may contain liquid refrigerant (solid arrow) and gaseous refrigerant (dotted arrow). The liquid refrigerant may flow downward toward the outlet 215 due to self-weight thereof. The liquid refrigerant may flow along the downwardly inclined guide surface 213.

The gaseous refrigerant may flow toward an upper portion of the main body 211 due to the lower density thereof, and then may be introduced into the plurality of extension tubes 220. Then, the gaseous refrigerant may flow upward along the plurality of extension tubes 220, and then, may be heat-exchanged with the outside.

The insulation material 26 may be disposed outside the plurality of extension tubes 220. In detail, the insulation material 26 may be disposed to contact the plurality of extension tubes 220. The insulation material 26 may be understood as a member disposed between the refrigerator compartment having an internal temperature of about 2° C. and the indoor space having a temperature of about 25° C. to block heat transfer due to a temperature difference therebetween.

The insulation material 26 may have a temperature of about 2° C. to about 25° C. On the other hand, the refrigerant condensed in the condenser 120 may have a temperature of about 30° C. to about 40° C. Thus, the plurality of extension tubes 220 and the insulation material 26 may be heat-exchanged (Q1) with each other through a conductive manner. Thus, the refrigerant may be condensed due to the heat exchange therebetween.

As a result, at least a portion of the gaseous refrigerant flowing into the plurality of extension tubes 220 may be condensed. The condensed refrigerant may flow downward along inner surfaces of the plurality of extension tubes 220, and then, may be stored in the liquid refrigerant storage 210.

The refrigerant flowing upward along the plurality of extension tubes 220 may be introduced into the gaseous refrigerant collection device 230. The gaseous refrigerant collection device 230 and the insulation material 26 may be heat-exchanged (Q2) with each other through a conductive manner. Thus, the refrigerant in the gaseous refrigerant collection device 230 may be condensed due to heat exchange therebetween. As a result, at least a portion of the refrigerant in the gaseous refrigerant collection device 230 may be condensed, and the condensed refrigerant may be stored in the liquid refrigerant storage device 210 via the plurality of extension tubes 220.

As described above, the two-phase refrigerant passing through the condenser 120 may be condensed while passing through the liquid refrigerant supply device 200, and the condensed refrigerant may be supplied into the dryer 170 or the flow adjuster 130. Thus, as the gaseous refrigerant is introduced into the flow adjuster 130, a large amount of liquid refrigerant may be introduced into one evaporator to prevent a large amount of gaseous refrigerant from being introduced into the other evaporator.

Hereinafter, a refrigeration cycle to which the liquid refrigerant supply device may be applied according to additional embodiments will be described hereinbelow.

In the following embodiments, a feature in which a liquid refrigerant supply device is connected to an outlet-side of a condenser, and a liquid refrigerant discharged from the liquid refrigerant supply device supplied into a flow adjuster via a dryer may be the same as the previous embodiment, and thus, repetitive detailed description thereof will be omitted. Different points when compared to the previous embodiment will be mainly described.

Figure 8:
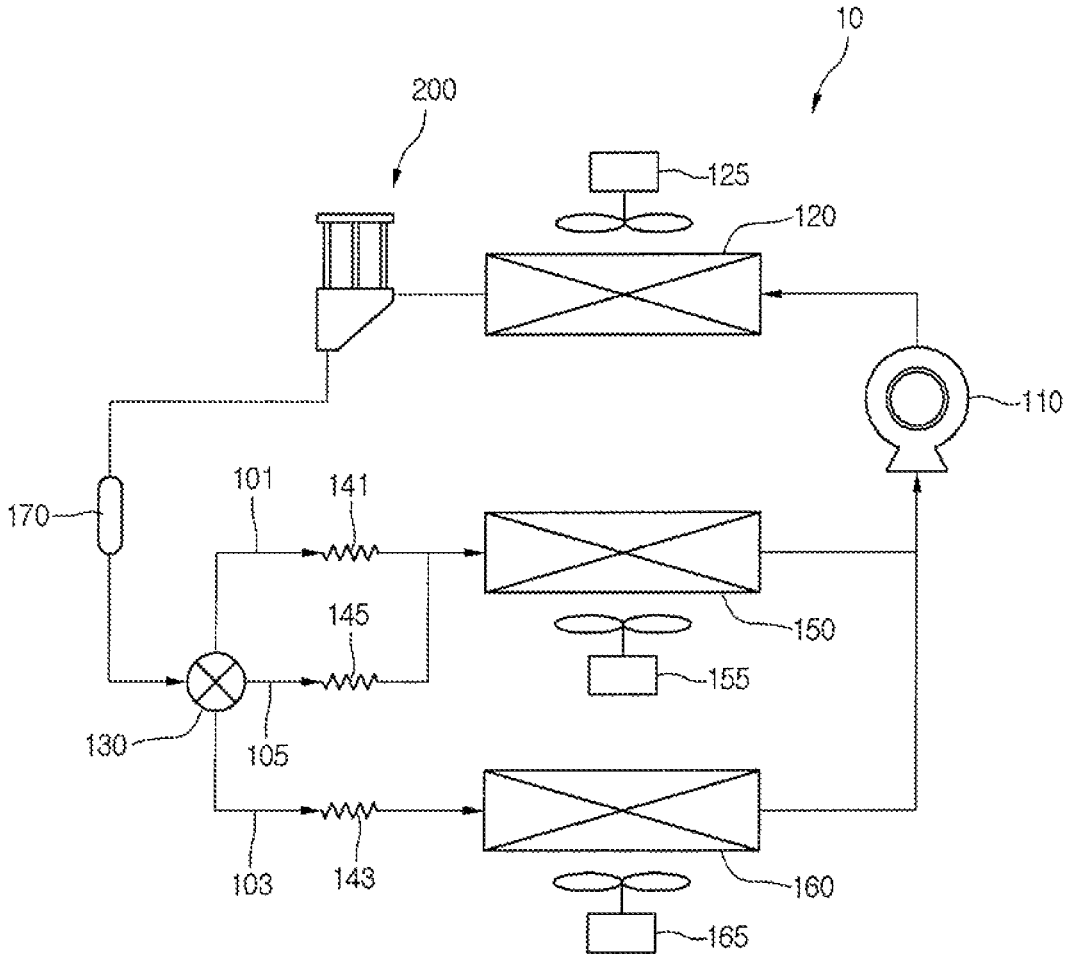
FIG. 8 is a schematic diagram of a refrigeration cycle in a refrigerator according to another embodiment.
Figure 9:
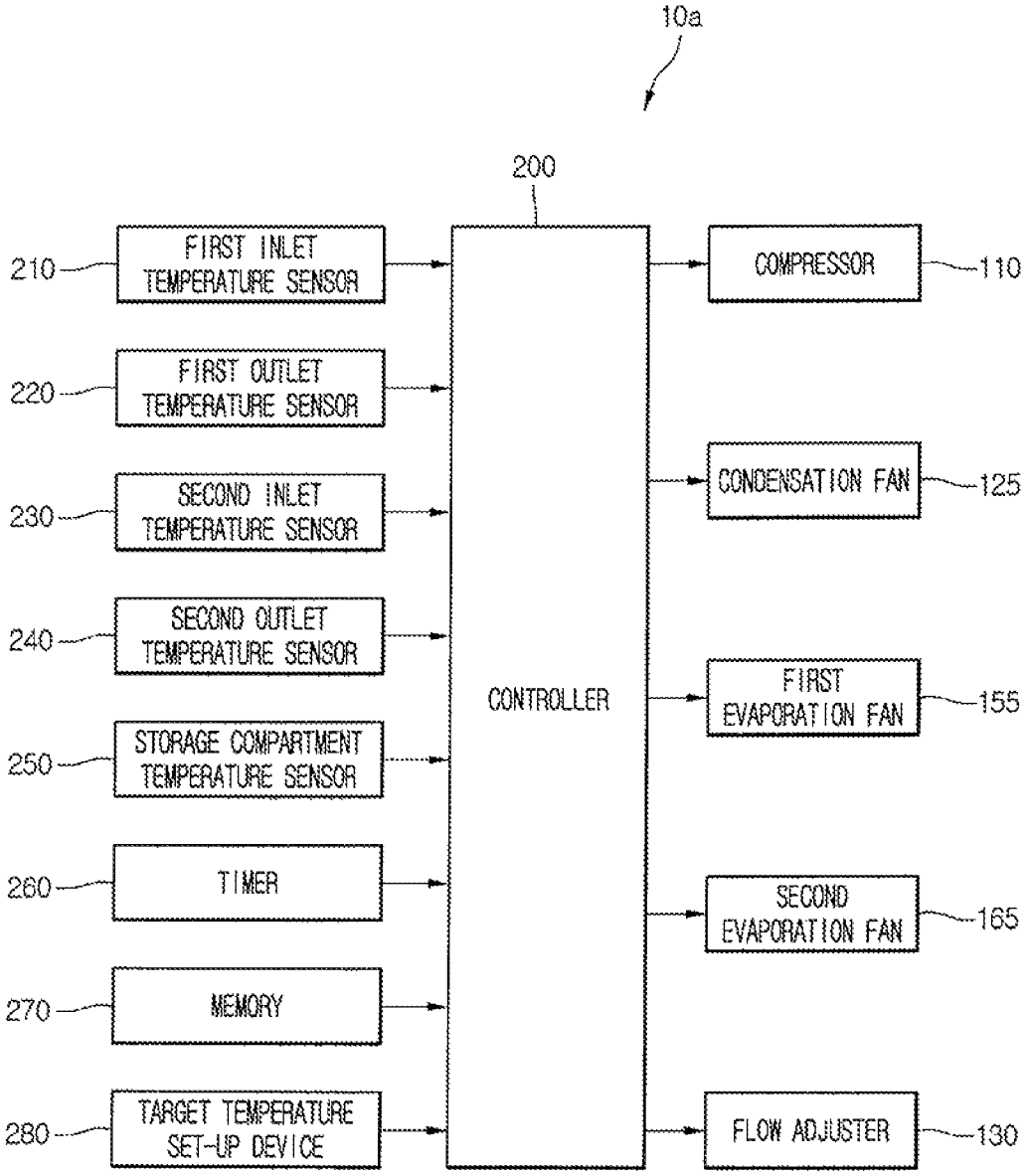
FIG. 9 is a block diagram of the refrigerator of FIG. 8.
Figure 10:
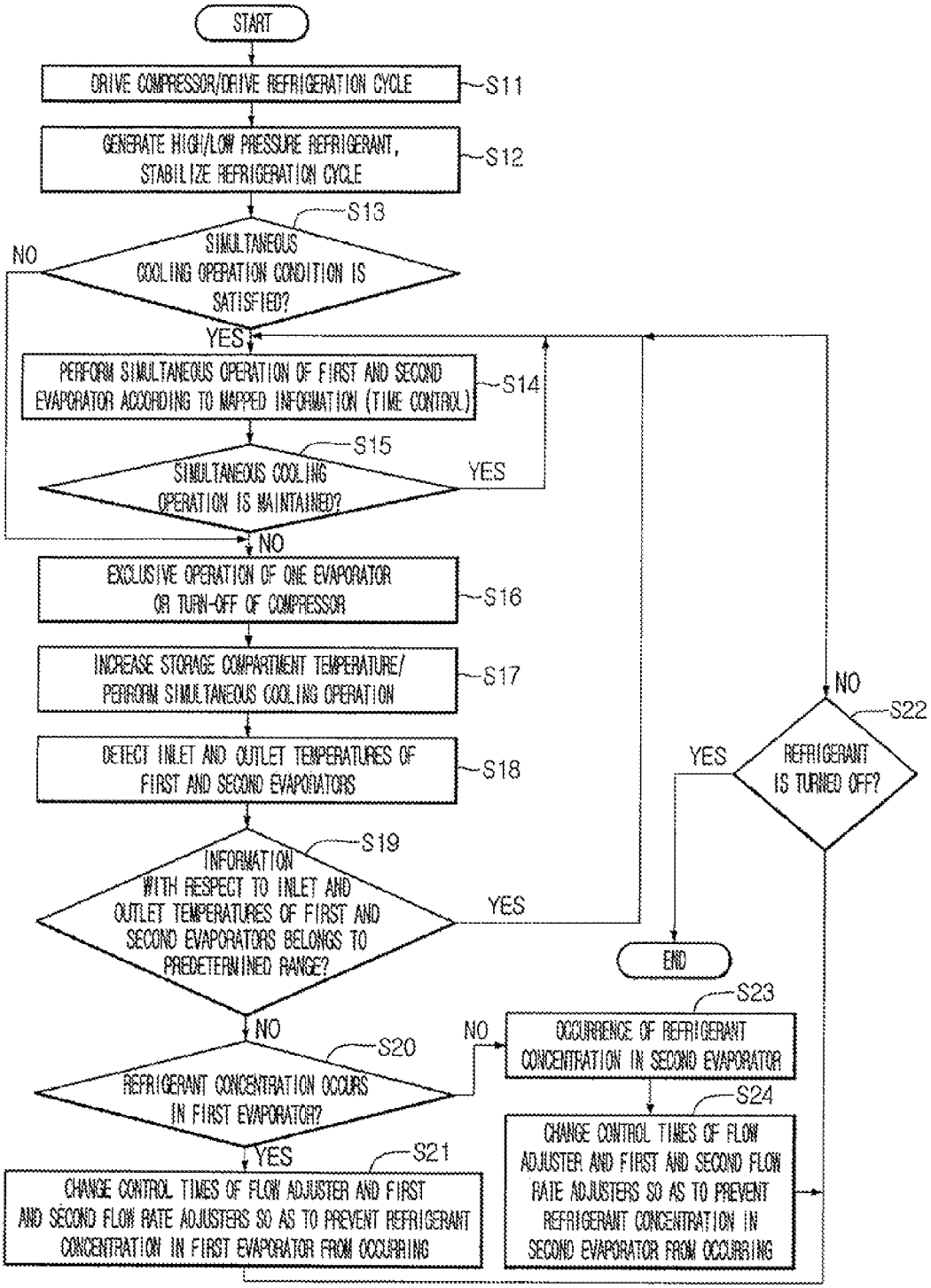
FIG. 10 is a flowchart of a method for controlling the refrigerator of FIG. 8.

FIG. 8 is a schematic diagram of a refrigeration cycle in a refrigerator according to another embodiment. FIG. 9 is a block diagram of the refrigerator of FIG. 8. FIG. 10 is a flowchart of a method for controlling the refrigerator of FIG. 8.

Referring to FIG. 8, refrigerator 10*a* according to this embodiment may include dryer 170, into which a liquid refrigerant discharged from liquid refrigerant supply device 200 may be introduced, flow adjuster 130 connected to the dryer 170, and first and second evaporators 150 and 160.

A plurality of refrigerant passages 101 and 105 to guide introduction of refrigerant into the first evaporator 150 may be defined in or at an inlet-side of the first evaporator 150. The plurality of refrigerant passages 101 and 105 may include first refrigerant passage 101, in which a first expansion device 141 may be disposed, and a third refrigerant passage 105, in which a third expansion device 145 may be disposed. Each of the first to third expansion devices 141, 143, and 145 may include a capillary tube.

The first and third refrigerant passages 101 and 105 may be referred to as a "first evaporation passage" in that the first and third refrigerant passages 101 and 105 may guide introduction of the refrigerant into the first evaporator 150. The refrigerants flowing into the first and third refrigerant passages 101 and 105 may be mixed with each other, and then, may be introduced into the first evaporator 150.

Also, one refrigerant passage 103 to guide introduction of the refrigerant into the second evaporator 160 may be defined in or at an inlet-side of the second evaporator 160. The one refrigerant passage 103 may include a second refrigerant passage 103, in which a second expansion device 143 may be disposed. The second refrigerant passage 103 may be referred to as a "second evaporation passage" in that the second refrigerant passage 103 may guide introduction of the refrigerant into the second evaporator 160.

The flow adjuster 130 may include a four-way valve having one inflow, through which the refrigerant may be introduced, and three discharges, through which the refrigerant may be discharged. A flow path of the refrigerant may vary according to a control of the flow adjuster 130. Also, control of the flow adjuster 130 may be performed on the basis of whether the refrigerant within the first or second evaporator 150 or 160 is excessive or lacking.

For example, when the first and second evaporators 150 and 160 operate simultaneously, if the refrigerant within the first evaporator 150 is relatively lacking, the flow adjuster 130 may be controlled so that the refrigerant flows into the first to third refrigerant passages 101, 103, and 105. On the other hand, if the refrigerant within the second evaporator 160 is relatively lacking, the third refrigerant passage 105 may be closed, and the flow adjuster 130 may be controlled so that the refrigerant flows into the first and second refrigerant passages 101 and 103.

That is, the flow passages 101 and 105 of the refrigerant to be introduced into the first evaporator 150 may be provided in plural, and flow of the refrigerant may be selectively controlled through the plurality of flow passages 101 and 105 to adjust an amount of refrigerant to be introduced into the first or second evaporator 150 or 160. As a larger amount of refrigerant flows into the inlet-side of the first evaporator 150 than the inlet-side of the second evaporator 160, when all of the first to third refrigerant passages 101, 103, and 105 are open, a relatively larger amount of refrigerant may flow into the first evaporator 150 than the second evaporator 160. When the second evaporator 160 serves as a freezer compartment-side evaporator, the second expansion device 143 may have a tube diameter somewhat less than a tube diameter of each of the first and third expansion devices 141 and 145. In this case, the refrigerant passing through the second expansion device 143 may have a decompression effect greater than a decompression effect of each of the first and third expansion devices 141 and 145.

Referring to FIG. 9, refrigerator 10*a* according to this embodiment may include a plurality of temperature sensors 210, 220, 230, and 240 to detect inlet or outlet temperatures of each of the first and second evaporators 150 and 160. The plurality of temperature sensors 210, 220, 230, and 240 may include first inlet temperature sensor 210 to detect an inlet-side temperature of the first evaporator 150, and first outlet temperature sensor 220 to detect an outlet-side temperature of the first evaporator 150. The plurality of temperature sensors 210, 220, 230, and 240 may further include second inlet temperature sensor 230 to detect an inlet-side temperature of the second evaporator 160, and second outlet temperature sensor 240 to detect an outlet-side temperature of the second evaporator 160.

The refrigerator 10 may further include controller 200 to control an operation of the flow adjuster 130 on the basis of temperatures detected by the plurality of temperature sensors 210, 220, 230, and 240. To perform simultaneous cooling operations of the refrigerator and freezer compartments, the controller 200 may control operations of the compressor 110, the condensation fan 125, and the first and second evaporation fans 155 and 165.

The refrigerator 10*a* may include storage compartment temperature sensor 250 to detect an inner temperature of the refrigerator storage compartment. The storage compartment temperature sensor 250 may include a refrigerator compartment temperature sensor disposed in the refrigerator compartment to detect an inner temperature of the refrigerator compartment and a freezer compartment temperature sensor disposed in the freezer compartment to detect an inner temperature of the freezer compartment.

The refrigerator 10*a* may further include a target temperature set-up device 280 to receive input of a target temperature of the refrigerator compartment or the freezer compartment from a user. For example, the target temperature set-up device 280 may be disposed on or at a position which is easily manipulated by a user on a front surface of the refrigerator compartment door or the freezer compartment door.

The information input through the target temperature set-up device 280 may become control reference information of the compressor 110, the plurality of blower fans 125, 155, and 165, and the flow adjuster 130. That is, the controller 200 may determine a simultaneous cooling operation of the refrigerator compartment and the freezer compartment, an exclusive operation of one storage compartment, or turn-off of the compressor 110 on the basis of the information input by the target temperature set-up device 280 and the information detected by the storage compartment temperature sensor 250.

For example, if inner temperatures of the refrigerator compartment and the freezer compartment are higher than that input through the target temperature set-up device 280, the controller 200 may control the compressor 110 and the flow adjuster 130 to perform the simultaneous cooling operation. On the other hand, if the inner temperature of the freezer compartment is higher than that input through the target temperature set-up device 280, and the inner temperature of the refrigerator compartment is lower than that input through the target temperature set-up device 280, the controller 200 may control the compressor 110 and the flow adjuster 130 to perform an exclusive cooling operation for the freezer compartment. Also, when the inner temperatures of the refrigerator compartment and the freezer compartment are lower than that input through the target temperature set-up device 280, the controller 200 may turn the compressor 110 off.

The refrigerator 10*a* may further include a timer 260 to determine a time elapsed value for operation of the flow adjuster 130 while the simultaneous cooling operation of the refrigerator compartment and the freezer compartment is performed. For example, the timer 260 may determine a time that has elapsed in a state in which both of the first and third refrigerant passages 101 and 105 are open, or a time that has elapsed in a state in which one of the first and third refrigerant passages 101 and 105 is open.

The refrigerator 10 may further include a memory 270 for mapping time values with respect to the adjusted state of the flow adjuster 130 and previously store the mapped values while the simultaneous cooling operation of the refrigerator compartment and the freezer compartment is performed.

In detail, in this embodiment, information mapped as shown in Table 1 below may be stored in the memory 270.

TABLE 1

| Refrigerant concentration | Case 1 | Case 2 |
|---|---|---|
| Simultaneous cooling operation start (reference value) | 90 seconds | 90 seconds |
| When refrigerant concentration occurs in first evaporator | 90 seconds | 120 seconds |
| When refrigerant concentration occurs in second evaporator | 90 seconds | 60 seconds |

Referring to Table 1 above, the "case 1" may be understood as a first control state (an adjusted state) of the flow adjuster 130, that is, a state in which an amount of refrigerant flowing into the first refrigerant passage 150 is greater than an amount of refrigerant flowing into the second refrigerant passage 160. In detail, the flow adjuster 130 may be controlled to open all of the first to third refrigerant passages 101, 103, and 105.

On the other hand, the "case 2" may be understood as a first control state (an adjusted state) of the flow adjuster 130, that is, a state in which an amount of refrigerant flowing into the second refrigerant passage 160 is greater than an amount of refrigerant flowing into the first refrigerant passage 150. In detail, the flow adjuster 130 may be controlled to open both of the first and second refrigerant passages 101 and 103.

For example, if simultaneous cooling operation conditions are satisfied, it may be determined that the cooling operation is required for both of the refrigerator compartment and the freezer compartment. Thus, the simultaneous cooling operation may start. The controller 200 may maintain the first control state for about 90 seconds, and then maintain the second control state for about 90 seconds. The first and second control states may be alternately performed if it is unnecessary to perform the simultaneous cooling operation.

While the first and second control states are repeatedly performed, when the inner temperature of the refrigerator compartment or the freezer compartment reaches a target temperature, supply of the refrigerant into at least one evaporator may be stopped (exclusive one evaporator operation). Also, when both of the inner temperatures of the refrigerator compartment and the freezer compartment reach the target temperature, the compressor 110 may be turned off.

When the exclusive one evaporator operation or the turn-off of the compressor 110 are maintained for a predetermined period of time, and it is needed to perform the simultaneous cooling operation of the refrigerator compartment and the freezer compartment, the controller 200 may determine whether refrigerant concentration in the first or second evaporator 150 or 160 occurs on the basis of the temperature values detected by the temperature sensors 210, 220, 230, and 240.

If it is determined that refrigerant concentration in the first evaporator 150 occurs, the controller 200 may change the time values according to cases 1 and 2 to apply the changed time values. That is, when refrigerant concentration in the first evaporator occurs, as a time to supply the refrigerant into the second evaporator 160 has to relatively increase, a control time with respect to case 2 may increase (about 120 seconds). On the other hand, when refrigerant concentration in the second evaporator occurs, as a time taken to supply the refrigerant into the first evaporator 150 has to relatively increase, a control time with respect to case 2 may decrease (about 60 seconds). That is, if it is determined that refrigerant concentration in one evaporator occurs, the control time with respect to case 2 may be adjusted to prevent the refrigerant concentration in the evaporator from occurring. It may be determined that a cooling load of the storage compartment in which the second evaporator 160 is disposed is less than a cooling load of the storage compartment in which the first evaporator 150 is disposed.

As a result, the control time with respect to case 1 to increase supply of the refrigerant into the storage compartment having the relatively large cooling load may be fixed, and the control time with respect to case 2 to increase supply of the refrigerant into the storage compartment having the relatively small cooling load may be changed. Thus, the storage compartment having the large cooling load may be stably maintained in cooling efficiency.

The control time of the flow adjuster 130 according case 1 may be referred to as a "first set-up time", and the control time of the flow adjuster 130 according to case 2 may be referred to as a "second set-up time".

In Table 1 above, the information with respect to the time value for successively performing cases 1 and 2 while the simultaneous cooling operation is performed, and the changing time for successively performing cases 1 and 2 when refrigerant concentration in the one evaporator occurs may be obtained through repeated experiments.

Referring to FIG. 10, a method for controlling a refrigerator according to this embodiment will be described.

To drive the refrigerator 10*a*, the compressor 110 may be driven. A refrigeration cycle according to the compression-condensation-expansion-evaporation of the refrigerant may operate according to the driving of the compressor 110, in step S11.

The simultaneous cooling operation of the refrigerator compartment and the freezer compartment may be initially performed according to the operation of the refrigeration cycle. When a predetermined period of time has elapsed, a pressure value according to the refrigerant circulation may reach a preset or predetermined range. That is, a high pressure of the refrigerant discharged from the compressor 110, and a low pressure of the refrigerant discharged from the first and second evaporators 150 and 160 may be set within the preset or predetermined range.

When the high and low pressures of the refrigerant are set within the preset or predetermined range, the refrigeration cycle may be stabilized to continuously operate. A target temperature of the storage compartment of the refrigerator may be previously set, in step S12.

While the refrigeration cycle operates, it may be determined whether simultaneous cooling operation conditions of the refrigerator compartment and the freezer compartment are satisfied. For example, if it is determined that the inner temperature of the refrigerator compartment and the freezer compartment is above the target temperature through the value detected by the storage compartment temperature sensor 250, the simultaneous cooling operation of the refrigerator compartment and the freezer compartment may be performed, in step S13.

When the simultaneous cooling operation is performed, the simultaneous operation of the first and second evaporators 150 and 160 may be performed according to the previously mapped information. That is, the flow adjuster 130 may be controlled in operation to simultaneously supply the refrigerant into the first and second evaporators 150 and 160.

As shown in Table 1 above, in the flow adjuster 130, the first adjustment state according to case 1 may be maintained for about 90 seconds, and the second adjustment state according to case 2 may be maintained for about 90 seconds. That is, a time control operation to prevent refrigerant concentration into the second evaporator 160 from occurring may be performed first according to case 1, and then a time control operation to prevent refrigerant concentration into the first evaporator 150 from occurring may be performed according to case 2, in step S14.

When the simultaneous cooling operation according to cases 1 and 2 is performed at least one time, it may be determined whether the simultaneous cooling operation of the refrigerator compartment and the freezer compartment has to be maintained. In detail, whether the temperature of the refrigerator compartment or the freezer compartment reaches the target temperature may be detected through the storage compartment temperature sensor 250.

If the temperature of the refrigerator compartment or the freezer compartment reaches the target temperature, it may be unnecessary to perform the cooling of the corresponding storage compartment, and thus, it may be unnecessary to perform the simultaneous cooling operation. Thus, when the exclusive cooling operation of the storage compartment, which does not reach the target temperature, that is, the exclusive cooling operation of the evaporator of the corresponding storage compartment is performed, or both of the storage compartments reach the target temperature, the compressor 110 may be turned off.

On the other hand, if both of the temperatures of the refrigerator compartment and the freezer compartment do not reach the target temperature, the process may return to the step S14 to again perform the simultaneous operation of the first and second evaporators 150 and 160. The simultaneous operation may be repeatedly performed until at least one of the refrigerator compartment or the freezer compartment reaches the target temperature.

As described above, while the simultaneous operation of the first and second evaporators 150 and 160 is performed, the control of the flow adjuster 130 according to cases 1 and 2 may be successively performed to prevent refrigerant concentration from occurring in the first and second evaporators 150 and 160, thereby improving cooling efficiency of the storage compartment and operation efficiency of the refrigerator, in steps S14 and S15.

In step S16, when a time has elapsed in a state in which the exclusive operation of one evaporator is performed, or the compressor 110 is turned off, the refrigerator compartment and the freezer compartment may increase in temperature. When the temperature of the refrigerator compartment or the freezer compartment increase to a temperature out of the target temperature range, it may be necessary to cool the storage compartment that increases in temperature or to operate the compressor 110 that is in the turn-off state. Also, the simultaneous cooling operation of the refrigerator compartment and the freezer compartment may be performed again, in step S17.

While the simultaneous cooling operation is performed again, change in the control time of the flow adjuster 130 according to cases 1 and 2 may be determined. In detail, the inlet and outlet temperatures of the first evaporator 150 may be detected by the first inlet and outlet temperature sensors 210 and 220. Also, the inlet and outlet temperatures of the second evaporator 160 may be detected by the second inlet and outlet temperature sensors 230 and 240, in step S18.

The controller 200 may determine an inlet/outlet temperature difference value of the first evaporator 150 and an inlet/outlet temperature difference value of the second evaporator 160. When an amount of refrigerant introduced into the first or second evaporator 150 or 160 is above an adequate refrigerant amount, the difference value between the inlet and outlet temperatures of the first or second evaporator 150 and 160 may decrease. On the other hand, when an amount of refrigerant introduced into the first or second evaporator 150 or 160 is below the adequate refrigerant amount, the difference value between the inlet and outlet temperatures of the first or second evaporator 150 or 160 may increase.

The controller 200 may determine whether information with respect to the difference value between the inlet and outlet temperatures of the first or second evaporator 150 or 160 belongs to a preset or predetermined range. That is, the controller 200 may determine whether an amount of refrigerant flowing into the first or second evaporator 150 or 160 is excessive or lacking, that is, whether the refrigerant is concentrated into the first or second evaporator 150 or 160, on the basis of the inlet/outlet temperature difference of the first evaporator 150 and the inlet/outlet temperature difference of the second evaporator 160. In detail, whether the amount of refrigerant flowing into the first or second evaporator 150 or 160 is excessive or lacking may be determined on the basis of the inlet/outlet temperature difference of the first evaporator 150, the inlet/outlet temperature difference of the second evaporator 160, or a ratio of the inlet/outlet temperature differences of the first and second evaporators 150 and 160, in step S19.

Hereinafter, a detailed determination method according to an embodiment will be described.

As an example of the determination method, it may be determined whether the refrigerant is concentrated according to whether the inlet/outlet temperature difference of the first evaporator 150 is equal to or greater or less than a preset or predetermined reference valve. The refrigerant circulated into the refrigeration cycle may be divided into the first and second evaporators 150 and 160 through the flow adjuster 130. Thus, when the inlet/outlet temperature difference of the first evaporator 150 is detected, a rate of the refrigerant passing through the first evaporator 150 may be determined. A rate of the refrigerant passing through the second evaporator 160 may be determined on the basis of the rate of the refrigerant passing through the first evaporator 150. For example, when the inlet/outlet temperature difference of the first evaporator 150 is greater than the reference value, it may be determined that an amount of refrigerant is lacking. On the other hand, it may be determined that an amount of refrigerant flowing into the second evaporator 160 is relatively large.

In this embodiment, a method for determining a refrigerant concentration phenomenon using the inlet/outlet temperature difference of the first evaporator 150 will be described. Of course, the refrigerant concentration phenomenon may also be determined using the inlet/outlet temperature difference of the second evaporator 160.

If the inlet/outlet temperature difference of the first evaporator 150 is equal to the preset or predetermined reference value (a reference temperature), it may be determined that refrigerant concentration into the first or second evaporator 150 or 160 may not occur. In this case, the process may return to step S14, and then, the flow adjuster 130 may be controlled on the basis of the time value that is set when the simultaneous cooling operation starts. That is, each of the adjusted states according to cases 1 and 2 may be maintained for about 90 seconds. Then, steps S15 to S18 may be performed again.

On the other hand, if the inlet/outlet temperature difference of the first evaporator 150 is not equal to the preset or predetermined reference value or is greater or less than the reference value, it may be determined that refrigerant concentration into the first or second evaporator 150 or 160 occurs. In detail, if the inlet/outlet temperature difference of the first evaporator 150 is less than the preset or predetermined reference value, it may be determined that a relatively large amount of refrigerant passes through the first evaporator 150. That is, it may be determined that refrigerant concentration into the first evaporator 150 occurs.

This case may correspond to "the occurrence of the refrigerant concentration in the first evaporator" shown in Table 1, and thus, the control state according to case 1 may be maintained for about 90 seconds, and the control state according to case 2 may increase to about 120 seconds. That is, as the adjusting time according to case 2 increases in preparation for the "simultaneous cooling operation start", an amount of refrigerant introduced into the first evaporator 150 may relatively decrease, in steps S20 and S21.

On the other hand, if the inlet/outlet temperature difference of the first evaporator 150 is greater than the preset or predetermined reference value, it may be determined that a relatively small amount of refrigerant passes through the first evaporator 150. That is, it may be determined that refrigerant concentration into the second evaporator 160 occurs. This case may correspond to "the occurrence of the refrigerant concentration in the first evaporator" shown in Table 1, and thus, the control state according to case 2 may be maintained for about 90 seconds, and the control state according to case 2 may decrease to about 60 seconds. That is, as the adjusting time of the flow adjuster 130 according to case 2 decreases in preparation for the "simultaneous cooling operation start", an amount of refrigerant introduced into the first evaporator 150 may relatively increase, in steps S23 and S24.

When the control time of the flow adjuster 130 is changed by the above-described method, the processes after step S14 may be performed again on the basis of the changed control time value unless the refrigerator is turned off, in step S22.

As described above, as the control time of the flow adjuster 130 changes on the basis of the information with respect to the inlet and outlet temperature difference of the first and second evaporators 150 and 160, refrigerant concentration in the first and second evaporators 150 and 160 may be prevented. Accordingly, cooling efficiency may be improved, and power consumption may be reduced.

Figure 11:
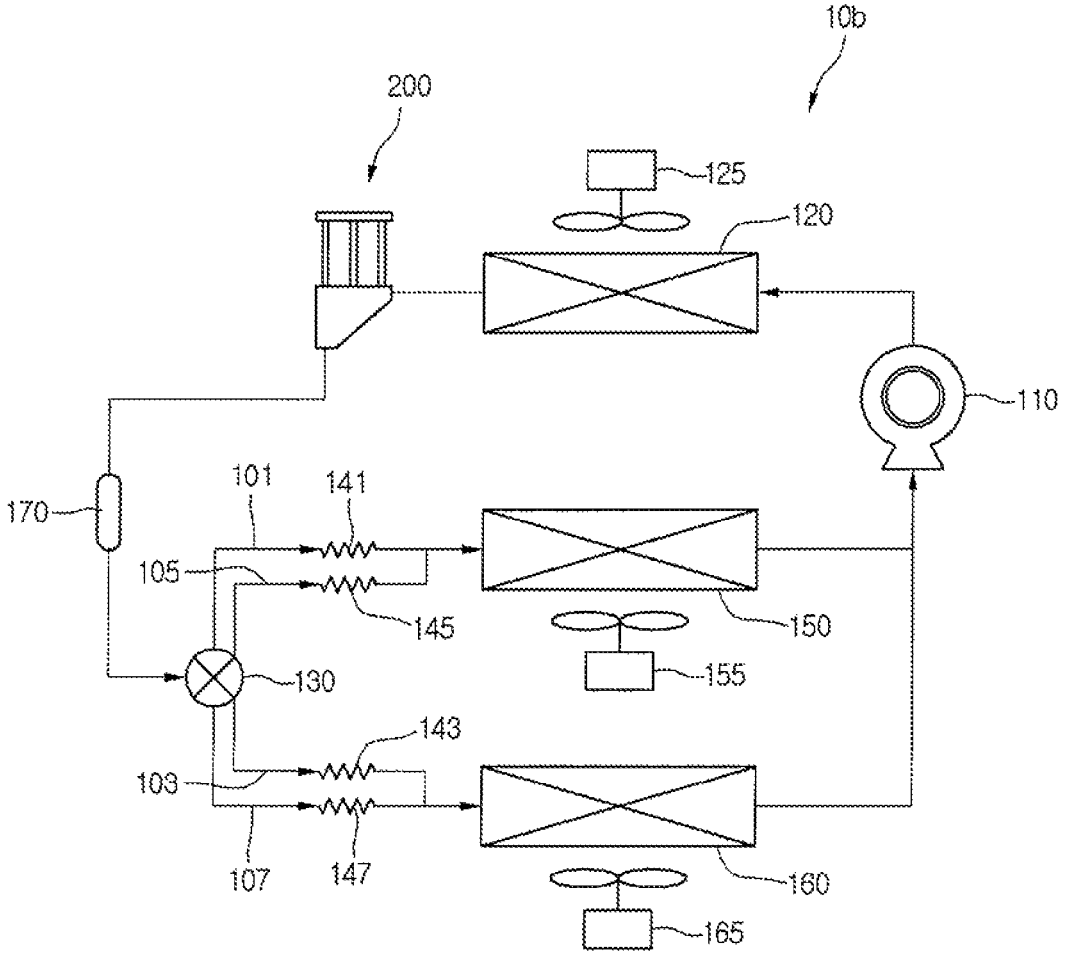
FIG. 11 is a schematic diagram of a refrigeration cycle in a refrigerator according to another embodiment.

FIG. 11 is a schematic diagram of a refrigeration cycle in a refrigerator according to another embodiment. Referring to FIG. 11, refrigerator 10*b* according to this embodiment may include a plurality of refrigerant passages 101, 103, 105, and 107 that extend from an outlet-side of flow adjuster 130 to first and second evaporators 150 and 160. The plurality of refrigerant passages 101, 103, 105, and 107 may be understood as "branch passages" that branch from refrigerant tube 100. The plurality of refrigerant passages 101, 103, 105, and 107 may include first and third refrigerant passages 101 and 103 connected to the first evaporator 150, and second and fourth refrigerant passages 103 and 107 connected to the second evaporator 160.

The first and third refrigerant passages 101 and 105 may be referred to as a "first evaporation passage" in that the first and third refrigerant passages 101 and 105 guide introduction of the refrigerant into the first evaporator 150. The second and fourth refrigerant passages 103 and 107 may be referred to as a "second evaporation passage" in that the second and fourth refrigerant passages 103 and 107 guide introduction of the refrigerant into the second evaporator 160.

The refrigerants flowing into the first and third refrigerant passages 101 and 105 may be mixed with each other, and then, may be introduced into the first evaporator 150. Also, the refrigerants flowing into the second and fourth refrigerant passages 103 and 107 may be mixed with each other, and then, may be introduced into the second evaporator 160.

A plurality of expansion devices 141, 143, 145, and 147 may be disposed in the plurality of refrigerant passages 101, 103, 105, and 107. Each of the plurality of expansion devices 141, 143, 145, and 147 may include a capillary tube. In detail, the plurality of expansion devices 141, 143, 145, and 147 may include a first expansion device 141 disposed in the first refrigerant passage 101, a second expansion device 143 disposed in the second refrigerant passage 103, a third expansion device 145 disposed in the third refrigerant passage 105, and a fourth expansion device 147 disposed in the fourth refrigerant passage 107.

The flow adjuster 130 may include a five-way valve having one inflow, through which the refrigerant may be introduced, and four discharges, through which the refrigerant may be discharged. The four discharges may be connected to the first to fourth refrigerant passages 101, 103, 105, and 107.

At least one of the first and third refrigerant passages 101 and 105, and at least one of the second and fourth refrigerant passages 103 and 104 may be open according to the control of the flow adjuster 130. For example, when the first to third refrigerant passages 101, 103, and 105 are open, and the fourth refrigerant passage 107 is closed, an amount of refrigerant introduced into the first evaporator 150 may be greater than an amount of refrigerant introduced into the second evaporator 160. On the other hand, when the first, second, and fourth refrigerant passages 101, 103, and 107 are open, and the third refrigerant passage 105 is closed, an amount of refrigerant introduced into the second evaporator 160 may be greater than an amount of refrigerant introduced into the first evaporator 150.

As described above, as the plurality of refrigerant passages and expansion devices are disposed on inlet sides of the first and second evaporators 150 and 160, and at least one refrigerant passage of the plurality of refrigerant passages may be opened or closed according to excess or leakage of the refrigerant to control an amount of refrigerant, a refrigerant concentration phenomenon into one evaporator may be prevented while the plurality of evaporators operate at the same time.

Figure 12:
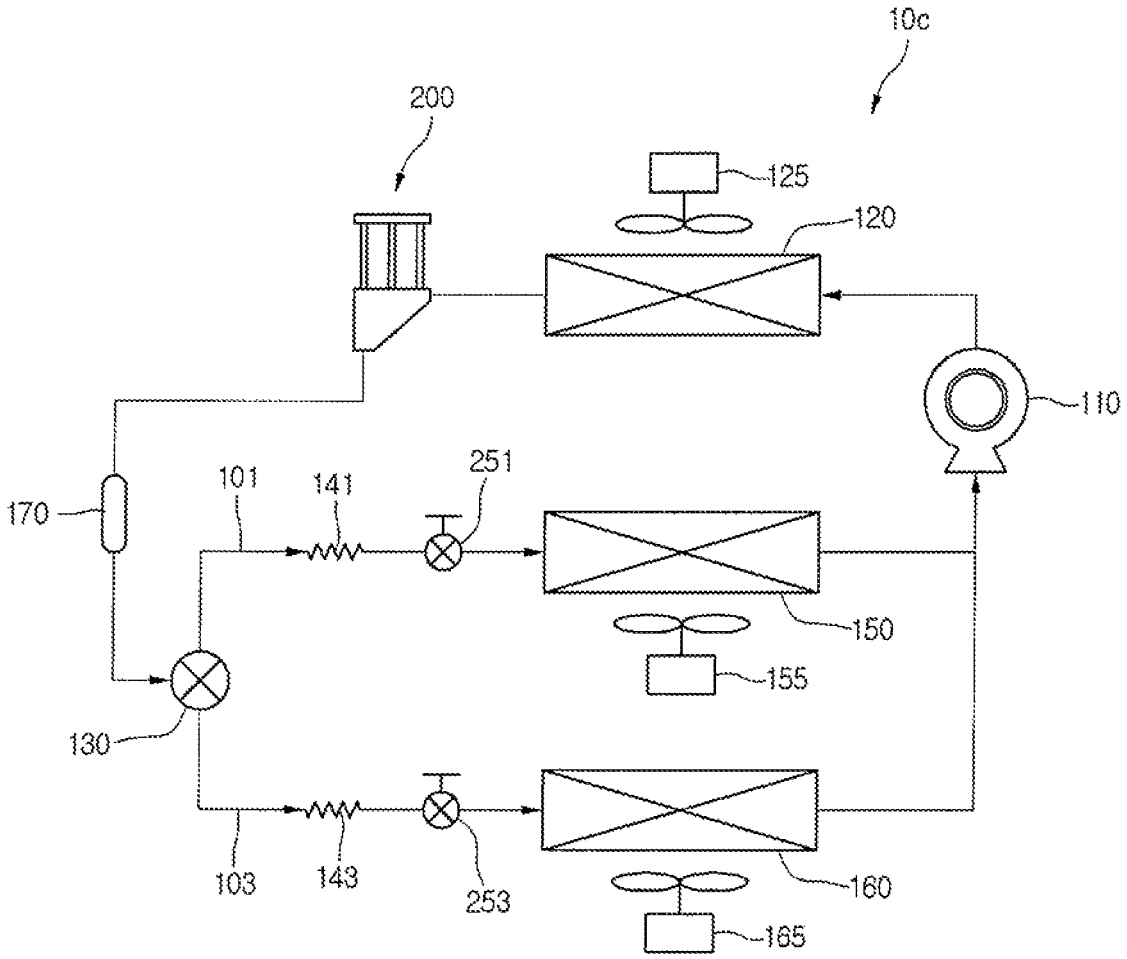
FIG. 12 is a schematic diagram of a refrigeration cycle in a refrigerator according to another embodiment.

FIG. 12 is a schematic view of a refrigeration cycle in a refrigerator according to another embodiment. Referring to FIG. 12, refrigerator 10*c* according to this embodiment may include a plurality of refrigerant passages 101 and 103 that extends from an outlet-side of flow adjuster 130 to first and second evaporators 150 and 160. The plurality of refrigerant passages 101 and 103 may be understood as "branch passages" that branch from refrigerant tube 100. The plurality of refrigerant passages 101 and 103 may include first refrigerant passage 101 connected to the first evaporator 150 and second refrigerant passage 103 connected to the second evaporator 160.

A plurality of expansion devices 141 and 143 may be disposed in the plurality of refrigerant passages 101 and 103. Each of the plurality of expansion devices 141 and 143 may include a capillary tube. In detail, the plurality of expansion devices 141 and 143 may include a first expansion device 141 disposed in the first refrigerant passage 101, and a second expansion device 143 disposed in the second refrigerant passage 103.

The flow adjuster 130 may include a three-way valve having one inflow, through which the refrigerant may be introduced, and two discharges, through which the refrigerant may be discharged. The two discharges may be connected to the first and second refrigerant passages 101 and 130. The flow adjuster 130 may be controlled so that the refrigerant is introduced into the first and second refrigerant passages 101 and 103 at the same time.

The refrigerator 10*c* may includes at least one flow amount adjuster 251 and 253 to adjust a flow of the refrigerant. The at least one flow rate adjuster 251 and 253 may be disposed in at least one refrigerant passage of the first and second refrigerant passages 101 and 103. For example, the at least one flow rate adjuster 251 and 253 may include a first flow rate adjuster 251 disposed in the first refrigerant passage 101, and a second flow rate adjuster 253 disposed in the second refrigerant passage 103. Each of the first and second flow rate adjusters 251 and 253 may include an electric expansion valve (EEV), an opening degree of which may be adjustable.

Although the first and second flow rate adjuster 251 and 253 are, respectively, disposed at outlet sides of the first and second expansion devices 141 and 143 in FIG. 12, embodiments are not limited thereto. For example, the first and second flow rate adjusters 251 and 253 may be disposed at inlet sides of the first and second expansion devices 141 and 143.

If the opening degree of the first or second flow rate adjuster 251 or 253 decreases, an amount of refrigerant flowing through an opening having the decreased opening degree may decrease. On the other hand, if the opening degree of the first or second flow rate adjuster 251 or 253 increases, an amount of refrigerant flowing through an opening having the increased opening degree may increase. For example, if an opening degree of the second flow rate adjuster 253 is relatively greater than an opening degree of the first flow rate adjuster 251, a larger amount of refrigerant may flow into the first refrigerant passage 101. On the other hand, if the opening degree of the second flow rate adjuster 253 is relatively greater than the opening degree of the first flow rate adjuster 251, a larger amount of refrigerant may flow into the second refrigerant passage 103.

As the first and second flow rate adjusters 251 and 253 are provided, the opening degree of each of the refrigerant passages may be finely adjustable. Thus, an amount of refrigerant to be introduced into the first or second evaporator 150 or 160 may be finely adjustable. As a result, while the first and second evaporators operate, the refrigerant concentration phenomenon into the first or second evaporator 150 or 160 may be prevented.

Figure 13:
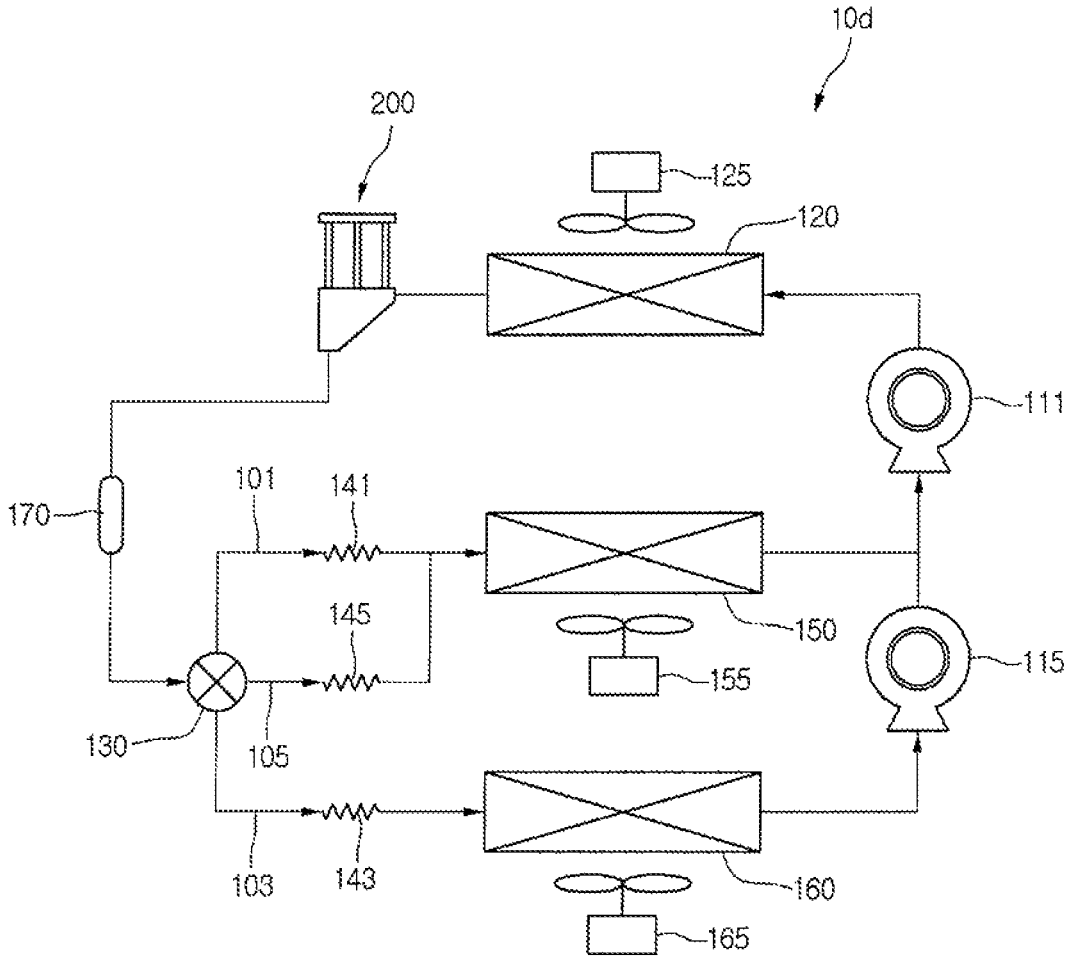
FIG. 13 is a schematic diagram of a refrigeration cycle in a refrigerator according to another embodiment.

FIG. 13 is a schematic diagram of a refrigeration cycle in a refrigerator according to another embodiment. Referring to FIG. 13, a refrigerator 10*d* according to this embodiment may include a plurality of compressors 111 and 115 that compress a refrigerant. In detail, the plurality of compressors 111 and 115 may include second compressor 115 disposed at a low-pressure side, and first compressor 111 to further compress the refrigerant compressed in the second compressor 115.

The first compressor 111 and the second compressor 115 may be connected to each other in series. That is, an outlet-side refrigerant tube of the second compressor 115 may be connected to an inlet-side of the first compressor 111. Also, an outlet-side refrigerant tube 100 of the second evaporator 160 may extend to an inlet-side of the second compressor 115. Thus, the refrigerant passing through the second evaporator 160 may be introduced into the second compressor 115.

The outlet-side refrigerant tube 100 of the first evaporator 150 may be connected to the outlet-side refrigerant tube of the second compressor 115. Thus, the refrigerant passing through the first evaporator 150 may be mixed with the refrigerant compressed in the second compressor 115, and then, the mixture may be suctioned into the first compressor 111.

The plurality of expansion devices 141, 143, and 145 may include first and third expansion devices 141 and 145 that expand the refrigerant to be introduced into the first evaporator 150, and second expansion device 143 that expands the refrigerant to be introduced into the second evaporator 160. Each of the first to third expansion devices 141, 143, and 145 may include a capillary.

A plurality of refrigerant passages 101 and 105 to guide introduction of the refrigerant into the first evaporator 150 may be defined or provided in or at the inlet-side of the first evaporator 150. The plurality of refrigerant passages 101 and 105 may include first refrigerant passage 101, in which the first expansion device 141 may be disposed, and third refrigerant passage 105, in which the third expansion device 145 may be disposed. Also, second refrigerant passage 103 to guide introduction of the refrigerant into the second evaporator 160 may be defined or provided in or at the inlet-side of the second evaporator 160.

Whether the first to third refrigerant passages 101, 103, and 105 are open may be determined according to whether refrigerant concentration in the first or second evaporator 150 or 160 occurs, similar to that discussed above with respect to the embodiment to FIGS. 8 and 10. As described above, the plurality of refrigerant passages may be provided at the inlet-side of the first evaporator 150 to control the opening or closing of the first evaporator 150. Thus, an amount of refrigerant introduced into the first or second evaporator 150 or 160 may be controlled to prevent refrigerant concentration into the first or second evaporator 150 or 160 from occurring.

According to embodiments disclosed herein, the liquid refrigerant supply device may be disposed on or at the outlet-side of the condenser to additionally condense the gaseous refrigerant of the refrigerant passing through the condenser, thereby supplying the liquid refrigerant into the dryer or the flow adjuster to improve condensation efficiency of the refrigerant. In particular, even though the flow adjuster is not maintained in physical balance, gaseous refrigerant may be concentrated into a portion of the plurality of evaporators to prevent evaporation efficiency of the evaporator from being deteriorated.

Also, as the liquid refrigerant supply device may include the liquid refrigerant storage disposed in the lower portion thereof, the at least one extension tube that extends upward from the liquid refrigerant storage, and the gaseous refrigerant collection device, refrigerant may be separated in phase by the density (gravity) difference between the gaseous and liquid refrigerants to easily discharge only the liquid refrigerant. Also, the gaseous refrigerant existing in the at least one extension tube and the gaseous refrigerant collection device may be additionally condensed through heat-exchange with external air, and then, may be collected into the lower portion of the liquid refrigerant supply device.

Also, as the liquid refrigerant supply device includes the insulation material between the outer case and the inner case of the main body of the refrigerator, a separate space to install the liquid refrigerant supply device may be unnecessary. Further, the insulation material may have a temperature ranging from a refrigerator compartment temperature (about 2° C.) of the refrigerator to an external temperature (about 25° C.) of the refrigerator. Thus, as the refrigerant is reduced in condensation temperature, gaseous refrigerant may be effectively condensed.

Also, as the plurality of evaporators may operate at the same time, the plurality of storage compartments may be effectively cooled. Further, as an amount of refrigerant supplied into the plurality of evaporators is adjustable on the basis of the previously determined time value, and the inlet and outlet temperature difference of the plurality of evaporators while the refrigerant operates, distribution of the refrigerant into the plurality of evaporators may be effectively realized. As a result, the first control process to increase an amount of refrigerant supplied into one evaporator of the plurality of evaporators, and the second control process to increase an amount of refrigerant supplied into the other evaporator of the plurality of evaporators may be basically performed according to the time period which may be set during the simultaneous cooling operation.

Also, as the inlet and outlet temperature information of the first and second evaporators may be confirmed or determined to change the control time values in the first and second control processes, refrigerant concentration into a specific evaporator of the plurality of evaporators may be prevented to realize precision control.

Embodiments disclosed herein provide a refrigerator having improved condensation efficiency of a refrigerant with respect to the related art.

Embodiments disclosed herein provide a refrigerator that may include at least one compressor that compresses a refrigerant; a condenser that condenses the refrigerant compressed in the at least one compressor; a refrigerant tube that guides the refrigerant condensed in the condenser; a plurality of evaporation passages, in which expansion devices may be respectively disposed, the plurality of evaporation passages branching from the refrigerant tube; a flow adjustment part or flow adjuster disposed in the refrigerant tube to supply the refrigerant into at least one evaporation passage of the plurality of evaporation passages; a plurality of evaporators, respectively, connected to the plurality of evaporation passages to evaporate the refrigerant decompressed in the plurality of expansion devices; and a liquid refrigerant supply device disposed at an outlet-side of the condenser to separate a liquid refrigerant of the refrigerant heat-exchanged in the condenser, thereby supplying the liquid refrigerant into the flow adjustment part. The liquid refrigerant supply device may include a liquid refrigerant storage part or storage including an inlet part or inlet, through which the refrigerant passing through the condenser may be introduced, and an outlet part or outlet, through the liquid refrigerant may be discharged. The liquid refrigerant storage part may have a guide surface that inclinedly extends downward from the inlet part toward the outlet part to guide a flow of the liquid refrigerant.

The liquid refrigerant supply device may further include at least one extension tube that extends upward from the liquid refrigerant storage part to provide a flow space for a gaseous refrigerant. The extension tube may be provided in plurality and coupled to a top surface of the liquid refrigerant storage part.

The liquid refrigerant supply part may further include a gaseous refrigerant collection part or device coupled to the extension tube to cross each other, thereby collecting the gaseous refrigerant. The gaseous refrigerant collection part may be disposed above the extension tube.

The refrigerator may further include a main body having a storage compartment. The main body may include an outer case that defines an exterior of the main body; an inner case that defines an exterior of the inside of the storage compartment, the inner case being assembled with the inside of the outer case; and an insulation material disposed between the outer case and the inner case. The liquid refrigerant supply device may be disposed in the insulation material. The storage compartment may include a refrigerator compartment and a freezer compartment, and the liquid refrigerant supply device may be disposed in the insulation material, which may be disposed at a rear side of the refrigerator compartment.

The refrigerator may further include a dryer connected to an outlet-side of the liquid refrigerant supply device to remove moisture or impurities. The liquid refrigerant, from which the moisture or impurities may be removed, may be introduced into the flow adjustment part.

The plurality of evaporation passages may include first and second refrigerant passages that guide introduction of the refrigerant into a first evaporator of the plurality of evaporators, and second refrigerant passage that guides introduction of the refrigerant into a second evaporator of the plurality of evaporators.

The refrigerator may further include a temperature sensor that detects inlet and outlet temperatures of the first evaporator, or inlet and outlet temperatures of the third evaporator; a memory that maps information with respect to a control time of the flow adjustment part and stores the mapped information; and a control unit or controller that controls the flow adjustment part to simultaneously supply the refrigerant into the first and third evaporators on the basis of the mapped information stored in the memory. The control unit may determine a change in the control time of the flow adjustment part on the basis of the information detected by the temperature sensor.

The information with respect to the control time of the flow adjustment part may include information with respect to a first set-up time, at which an amount of refrigerant supplied into the first evaporator increases to prevent the refrigerant from being concentrated into the second evaporator, and information with respect to a second set-up time, at which an amount of refrigerant supplied into the second evaporator to prevent the refrigerant from being concentrated into the first evaporator. The control unit may increase the second set-up time when it is determined that refrigerant concentration into the first evaporator occurs, and decrease the second set-up time when it is determined that refrigerant concentration into the second evaporator occurs according to the information detected by the temperature sensor.

The flow adjustment part may be controlled to open the first to third refrigerant passages for a first set-up time, thereby increasing the amount of refrigerant supplied into the first evaporator, and be controlled to open the first and second refrigerant passages for a second set-up time, thereby increasing the amount of refrigerant supplied into the second evaporator.

The refrigerator may further include a fourth refrigerant passage that guides introduction of the refrigerant into the second evaporator. The flow adjustment part may operate to divide the refrigerant into the first to fourth refrigerant passages.

A flow rate adjustment part or flow adjuster which may be controllable in opening degree may be disposed in each of the plurality of evaporation passages. The flow adjustment part may include a four-way valve or five-way valve.

The details of one or more embodiments are set forth in the accompanying drawings and the description below. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in-connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

at least one compressor that compresses a refrigerant;

a condenser that condenses the refrigerant compressed in the at least one compressor;

a refrigerant tube that guides a flow of the refrigerant condensed in the condenser;

a plurality of evaporation passages, in which expansion devices are, respectively, disposed, the plurality of evaporation passages branching from the refrigerant rube;

a flow adjuster disposed in the refrigerant tube to supply the refrigerant into at least one evaporation passage of the plurality of evaporation passages;

a plurality of evaporators, respectively, connected to the plurality of evaporation passages to evaporate the refrigerant decompressed in the expansion devices; and a liquid refrigerant supply device disposed at an outlet-side of the condenser to separate a liquid refrigerant of the refrigerant heat-exchanged in the condenser, thereby supplying the liquid refrigerant into the flow adjuster, wherein the liquid refrigerant supply device comprises:

a liquid refrigerant storage comprising an inlet, through which the refrigerant that passes through the condenser is introduced, and an outlet, through which the liquid refrigerant is discharged;

at least one extension tube extends upward from the liquid refrigerant storage to provide a flow space for a gaseous refrigerant; and a gaseous refrigerant collection device coupled to the at least one extension tube to cross each other, thereby collecting the gaseous refrigerant.

2. The refrigerator according to claim 1, wherein the liquid refrigerant storage has a guide surface inclined downward from the inlet toward the outlet to guide a flow of the liquid refrigerant.

3. The refrigerator according to claim 1, wherein the at least one extension tube comprises a plurality of extension tubes coupled to a top surface of the liquid refrigerant storage.

4. The refrigerator according to claim 1, wherein the gaseous refrigerant collection device is disposed above the at least one extension tube.

5. The refrigerator according to claim 1, further comprising a main body having a storage compartment, wherein the main body comprises:

an outer case that defines an exterior of the main body;

an inner case that defines an exterior of an inside of the storage compartment, the inner case being assembled with an inside of the outer case; and an insulation material disposed between the outer case and the inner case.

6. The refrigerator according to claim 5, wherein the liquid refrigerant supply device is disposed in the insulation material.

7. The refrigerator according to claim 5, wherein the storage compartment comprises a refrigerator compartment and a freezer compartment, and wherein the liquid refrigerant supply device is disposed in the insulation material, which is disposed at a rear side of the refrigerator compartment.

8. The refrigerator according to claim 1, further comprising a dryer connected to an outlet-side of the liquid refrigerant supply device to remove moisture or impurities, wherein the liquid refrigerant from which moisture or impurities are removed is introduced into the flow adjuster.

9. The refrigerator according to claim 1, wherein the plurality of evaporation passages comprises:

first and second refrigerant passages that guide introduction of the refrigerant into a first evaporator of the plurality of evaporators; and a third refrigerant passage that guide introduction of the refrigerant into a second evaporator of the plurality of evaporators.

10. The refrigerator according to claim 9, further comprising:

at least one temperature sensor that detects inlet and outlet temperatures of the. first evaporator, or inlet and outlet temperatures of the second evaporator;

a memory that stores map information with respect to a control time of the flow adjuster; and a controller that controls the flow adjuster to supply the refrigerant into the first and second evaporators on the basis of the mapped information stored in the memory, wherein the controller determines whether the control time of the flow adjuster is changed, on the basis of the information detected by the at least one temperature sensor.

11. The refrigerator according to claim 10, wherein the information with respect to the control time of the flow adjuster comprises:

information with respect to a first set-up time, at which time an amount of refrigerant supplied into the first evaporator increases to prevent the refrigerant from being concentrated into the second evaporator; and information with respect to a second set-up time, at which time an amount of refrigerant supplied into the second evaporator increases to prevent the refrigerant from being concentrated into the first evaporator.

12. The refrigerator according to claim 11, wherein the controller increases the second set-up time when it is determined that refrigerant concentration into the first evaporator occurs, and decreases the second set-up time when it is determined that refrigerant concentration into the second evaporator occurs, according to the information detected by the at least one temperature sensor.

13. The refrigerator according to claim 12, wherein the controller controls the flow adjuster to open the first to third refrigerant passages for a first set-up time, thereby increasing the amount of refrigerant supplied into the first evaporator, and to open the first and second refrigerant passages for a second set-up time, thereby increasing the amount of refrigerant supplied into the second evaporator.

14. The refrigerator according to claim 9, further comprising a fourth refrigerant passage that guides introduction of the refrigerant into the second evaporator, wherein the flow adjuster operates to divide the refrigerant into the first to fourth refrigerant passages.

15. The refrigerator according to claim 1, wherein a flow rate adjuster that is controllable in opening degree is disposed in each of the plurality of evaporation passages.

16. The refrigerator according to claim 1, wherein the flow adjuster comprises a four-way valve or a five-way valve.

17. A refrigerator, comprising:

at least one compressor that compresses a refrigerant;

a condenser that condenses the refrigerant compressed the at least one compressor;

a refrigerant tube that guides a flow of the refrigerant condensed in the condenser;

a plurality of evaporation passages, in which expansion devices are, respectively, disposed, the plurality of evaporation passages branching from the refrigerant tube;

a flow adjuster disposed in the refrigerant tube to supply the refrigerant into at least one evaporation passage of the plurality of evaporation passages;

a plurality of evaporators, respectively, connected to the plurality of evaporation passages to evaporate the refrigerant decompressed in the expansion devices; and a liquid refrigerant supply device disposed at an outlet-side of the condenser to separate a liquid refrigerant of the refrigerant heat-exchanged in the condenser, thereby supplying the refrigerant into the flow adjuster, wherein the liquid refrigerant supply device comprises:

a liquid refrigerant storage comprising an inlet, through which the refrigerant that passes through the condenser is introduced, and an outlet, through which the liquid refrigerant is discharged; and a plurality of extension tubes that extends upward from the liquid refrigerant storage to provide a flow space for a gaseous refrigerant and is coupled to a top surface of the liquid refrigerant storage.

18. The refrigerator according to claim 17, wherein a flow rate adjuster that is controllable in opening degree is disposed in each of the plurality of evaporation passages.

19. The refrigerator according to claim 17, wherein the flow adjuster comprises a four-way valve or a five-wav valve.

20. A refrigerator, comprising:

at least one compressor that compresses a refrigerant;

a condenser that condenses the refrigerant compressed in the at least one compressor;

a refrigerant tube that guides a flow of the refrigerant condensed in the condenser;

a plurality of evaporation passages, in which expansion devices are, respectively, disposed, the plurality of evaporation passages branching from the refrigerant tube, the plurality of evaporation passages comprising:

first and second refrigerant passages that guide introduction of the refrigerant into a first evaporator, the first evaporator being connected to the first and second refrigerant passages to evaporate the refrigerant decompressed in the expansion devices; and a third refrigerant passage that guide introduction of the refrigerant into a second evaporator, the second evaporator being connected to the third refrigerant passage to evaporate the refrigerant decompressed in the expansion devices;

a flow adjuster disposed in the refrigerant tube to supply the refrigerant into at least one evaporation passage of the plurality of evaporation passages;

a liquid refrigerant supply device disposed at an outlet-side of the condenser to separate a liquid refrigerant of the refrigerant heat-exchanged in the condenser, thereby supplying the liquid refrigerant into the flow adjuster;

at least one temperature sensor that detects inlet and outlet temperatures of the first evaporator, or inlet and outlet temperatures of the second evaporator;

a memory that stores map information with respect to a control time of the flow adjuster; and a controller that controls the flow adjuster to supply the refrigerant into the first and second evaporators on the basis of the mapped information stored in the memory, wherein the controller determines whether the control time of the flow adjuster is changed, on the basis of the information detected by the at least one temperature sensor.

21. The refrigerator according to claim 20, wherein the information with respect to the control time of the flow adjuster comprises:

information with respect to a first set-up time, at which time an amount of refrigerant supplied into the first evaporator increases to prevent the refrigerant from being concentrated into the second evaporator; and information with respect to a second set-up time, at which time an amount of refrigerant supplied into the second evaporator increases to prevent the refrigerant from being concentrated into the first evaporator.

22. The refrigerator according to claim 21, wherein the controller increases the second set-up time when it is determined that refrigerant concentration into the first evaporator occurs, and decreases the second set-up time when it is determined that refrigerant concentration into the second evaporator occurs, according to the information detected by the at least one temperature sensor.

23. The refrigerator according to claim 22, wherein the controller controls the flow adjuster to open the first to third refrigerant passages for a first set-up time, thereby increasing the amount of refrigerant supplied into the first evaporator, and to open the first and second refrigerant passages for a second set-up time, thereby increasing the amount of refrigerant supplied into the second evaporator.

24. The refrigerator according to claim 20, further comprising a fourth refrigerant passage that guides introduction of the refrigerant into the second evaporator, wherein the flow adjuster operates to divide the refrigerant into the first to fourth refrigerant passages.

25. The refrigerator according to claim 20, wherein a flow rate adjuster that is controllable in opening degree is disposed in each of the plurality of evaporation passages.

26. The refrigerator according to claim 20, wherein the flow adjuster comprises a four-way valve or a five-way valve.

* * * * *